US007887147B2

(12) United States Patent
Karg

(10) Patent No.: US 7,887,147 B2
(45) Date of Patent: Feb. 15, 2011

(54) FURNITURE ITEM

(75) Inventor: David Karg, Bregenz (AT)

(73) Assignee: Julius Blum GmbH, Hochst (AT)

( * ) Notice: Subject to any disclaimer, the term of this patent is extended or adjusted under 35 U.S.C. 154(b) by 26 days.

(21) Appl. No.: 11/976,757

(22) Filed: Oct. 26, 2007

(65) Prior Publication Data

US 2008/0048538 A1 Feb. 28, 2008

Related U.S. Application Data

(63) Continuation of application No. PCT/AT2006/000175, filed on Apr. 28, 2006.

(30) Foreign Application Priority Data

Apr. 28, 2005 (AT) ..... A 717/2005

(51) Int. Cl.
*A47B 97/00* (2006.01)

(52) U.S. Cl. ..... 312/319.2

(58) Field of Classification Search ..... 312/257.1, 312/294, 330.1, 333, 319.1, 319.2, 319.5, 312/319.6, 401, 405, 326; 49/386; 318/466
See application file for complete search history.

(56) References Cited

U.S. PATENT DOCUMENTS 1,334,712 A * 3/1920 Olson ..... 312/234.1
3,674,329 A 7/1972 Schill
4,978,152 A 12/1990 Bisbing
6,338,536 B1 * 1/2002 Ueno et al. ..... 312/405
6,711,856 B1 * 3/2004 Hoffman ..... 49/386
2004/0055221 A1 3/2004 Hoffman

FOREIGN PATENT DOCUMENTS

| | | |
|---|---|---|
| DE | 1778452 | * 10/1971 |
| DE | 20 2004 007 168 | 9/2004 |
| EP | 1 314 842 | 5/2003 |
| GB | 1157149 | 7/1969 |
| WO | 2004/101919 | 11/2004 |

OTHER PUBLICATIONS

International Search Report issued Oct. 10, 2006 in International (PCT) Application PCT/AT2006/000175.

* cited by examiner

*Primary Examiner*—James O Hansen
(74) *Attorney, Agent, or Firm*—Wenderoth, Lind & Ponack, L.L.P.

(57) ABSTRACT

The invention relates to an item of furniture including a furniture body, a furniture part which is displaceably received in or on the furniture body, and an ejection device having at least one ejection element for displacing the moveable furniture part from a closed position into a first open position. At least one lockable drive device is provided for driving the at least one ejection element. The invention is characterized by means for displacing the at least one ejection element beyond the first open position.

23 Claims, 15 Drawing Sheets

FURNITURE ITEM

This application is a continuation of International Application No. PCT/AT2006/000175, filed Apr. 28, 2006.

BACKGROUND OF THE INVENTION

The invention concerns a furniture item with a furniture body and a movable furniture part located in or on the furniture body, and an ejection device which has an ejection element to move the movable furniture part out of a closed position into a first open position, and a latchable actuator for the ejection element. Furthermore, a process for opening and closing the new type of furniture item will be proposed.

Furniture items of this type are known already in the state of the art in which typical ejection devices are designated as so-called "touch-latch" mechanisms. These require pressure (a touch) to be applied, for example, to the movable furniture part, a switch, button or something of that nature to unlatch the ejection device, which has the effect of moving the movable furniture part by means of the ejection element from its closed position into a first open position. If the actuator comprises a manually loaded energy accumulator, the loading of the latter is usually effected when the furniture item is closed. It has been found that an unsatisfactory aspect of this state of the art is that the user has only part of the closure path immediately by the closed position to load the energy accumulator.

The invention sets out, therefore, to propose an improved version of the furniture item in question which will avoid the drawbacks recognized in the state of the art. The proposal will include a process for opening and closing the new type of furniture item.

The invention resolves this task by providing a means of moving one or more ejection elements beyond of the first open position.

In the case of actuators generally comprising a manually loaded energy accumulator, preferably a tension spring, to preload the energy accumulator, the ejection element on which the accumulator acts over a part of the closure path is in contact with either the movable furniture part or with the furniture body, depending on whether the ejection device is arranged on the furniture body or on the movable furniture part. In those ejection devices known up to the present time, this contact action occurs in the section of the opening or closing path of the movable furniture part located between the closed end position and the first open position of the movable furniture part whereby the first open position of the movable furniture part corresponds to the position of the ejection element after the end of the ejection process. This means that the user, when closing the movable furniture part, may just move it slightly to reach the first open position before having to apply additional pressure in the last section of the closing path to load the energy accumulator.

SUMMARY OF THE INVENTION

In contrast, in the furniture item according to the invention, an arrangement is proposed whereby, once the ejection process has ended, the ejection element is moved beyond the first open position of the furniture part, and the partial section of the closing path in which the ejection element is in contact with the movable furniture part, or furniture body as the case may be, to load the energy accumulator, is displaced in the direction of the opened end position. This means that, immediately after or simultaneous with the start of the closing motion of the movable furniture part, the user begins to load the energy accumulator of the actuator and, at the end of the loading process, has then to apply a small force to move the movable furniture part into its closed end position. This will give the user the impression that the closure of the movable furniture part is a completely smooth closing motion.

According to a first design example of the invention, the means directly or indirectly contacting or contactable with the ejection element provided to move at least one ejection element through the first open position are arranged on the movable furniture part regardless of whether the movable furniture part is in the form of a door, lid or drawer.

This lends itself to a simple design whereby the means include at least a first part arranged on the movable furniture part and at least a second part arranged on the ejection element such that they exert a magnetic attractive force on one another. Other solutions are possible, naturally. Thus, it is possible, for example, that the first part could be formed as a hinged rod arranged on the movable furniture part and the second part of the means could be arranged, for example, in the form of a longitudinal guide on the ejection element.

According to another design example of the invention, the means directly or indirectly contacting or contactable with the ejection element provided to move at least one ejection element beyond the first open position are arranged on the furniture body and/or in or on the ejection device. A preferred design example according to the invention provides that the actuator in addition to the ejection device has at least one additional auxiliary actuator which constitutes the means for moving the ejection element during the opening of the movable furniture part beyond the first open position.

A simple but nevertheless sturdy solution for this is if the auxiliary actuator is an energy accumulator, preferably manually loaded and preferably a pressure spring.

Although it would also be conceivable to configure the movement of the ejection element beyond the first open position to be independent of the movement of the movable furniture part, a technically simple solution is achieved if the one (or more) ejection element in the ejection device stays in contact or follows the movable furniture part in at least one part section of the opening or closing path of the movable furniture part situated between the first open position and the closed end position. Beneficially, the one (or more) ejection element in the ejection device is in contact with the movable furniture part during 50%, or preferably 80%, of the opening or closing path of the movable furniture part.

According to an alternative design version of the invention, it is arranged that the means for moving the ejection element during the opening of the movable furniture part through the first open position which is directly or indirectly linked with the ejection element is fitted to the furniture body and/or to the ejection device.

Regardless of whether the ejection element is arranged on the furniture body or on the movable furniture part so that it moves linearly or rotates, a further design example of the invention provides that the furniture part is located translationally movable in or on the furniture body, for example in the form of a drawer. According to another design example of the invention, the movable furniture part can, however, be located rotationally movable in or on the furniture body, again regardless of whether the ejection element is arranged on the furniture body or on the movable furniture part so that it moves linearly or rotates.

This means that the invention is suitable for all conceivable combinations of a movable furniture part with an ejection element, as long as it is ensured that the location of the ejection element changes in relation to its starting position with a latched ejection device in the first open position, i.e., after completion of the ejection process and at the start of the loading process. In other words, the distance between the contact point of the ejection element in the starting position and the contact point in its position after the end of the ejection process on the one hand, and the distance between the contact point of the ejection element in the starting position and the contact point in its position after the end of the opening process on the other hand must be different.

A preferred design example is characterised by a rotatable ejection element whereby there is a difference between the opening angle of the ejection element in its position after the end of the ejection process in the first open position of the movable furniture part on the one hand, and the opening angle of the ejection element in its position after the end of the opening process in the opened end position of the movable furniture part on the other.

In the case where the movable furniture part is pivotably supported, the maximum opening angle of the ejection element is favorably approximately equal (as close as possible) to the maximum opening angle of the movable furniture part, whereby the ejection element can follow the movable furniture part substantially during the entire opening path of the movable furniture part.

According to a further preferred design version of the invention, the ejection device is formed to at least partly load the energy accumulator of the actuator for the ejection element during a closing movement of the movable furniture part in a part section of the opening or closing path of the movable furniture part located between the opened end position and the first open position. Thus, the closing of the movable furniture part is quiet and smooth if the ejection device is constructed to start the loading process of the energy accumulator in general with each closing movement of the movable furniture part, preferably regardless of the position of the movable furniture part.

If, in this alternative design, the ejection element is pivoted, it can be further arranged that there is a difference between the opening angle of the ejection element at the end of the ejection process in the first open position of the movable furniture part on the one hand, and the angle at the start of the loading process of the energy accumulator on the other, or, respectively, the distance between the contact point of the ejection element in the home position and the contact point at the end of the ejection process on the one hand, and the distance between the contact point of the ejection element in the home position and the contact point at the start of the loading process of the energy accumulator, on the other.

According to a preferred example of the invention, the ejection device has a pivoted ejection element and a latchable actuator, preferably a coil tension spring, which interact with a transmission device, preferably a gear train. A simple means can be arranged whereby the ejection element is linked to the actuator through a link element and has a section with gear teeth that is formed to engage with a driving pinion secured to a bearing element which can rotate. This method can save space if at least the ejection element, the bearing element for the driving pinion and the link element are arranged coaxially.

Latching of the ejection device can be arranged, for example, by using a detent or a catch guided in a heart-shaped slide track, as provided for in a further design example according to the invention, via an elbow lever and/or a dead point mechanism.

The free running needed between the driving pinion and the link element to move the ejection element beyond the first open position is arranged in a further design example according to the invention, in which one arm of the elbow lever is pivoted at its free end with the link element. The dead point mechanism has a lever which is pivoted at one end with the elbow of the elbow lever and at the other end pivoted with a curved coupling element, whereby the curved coupling element is secured, preferably coaxially with the link element, so that it will rotate.

It is necessary in loading the energy accumulator to eliminate free movement between the coupling element and the pinion to be able to transfer the force acting on the ejection element to the link element. According to a design example of the invention, this is achieved by connecting the driving pinion, so that it will not turn, to a coaxial brake disk whereby the brake disk is shaped so that it is in contact at its perimeter with the curved coupling element. This means that, immediately following or at the start of the closing process of the movable furniture part, the brake disk is brought into contact at its perimeter with the curved coupling element, thus blocking the rotation of the pinion, and the force of the movable furniture part, which is closing, acting on the ejection element is transferred to the link element, a process which loads the energy accumulator.

A simple configuration of the ejection device is provided according to a preferred design example if the ejection device is arranged in a housing with an outlet aperture at least for the ejection element. The housing can then be fitted simply in a suitable location either on the movable furniture part or on the furniture body.

To ensure that the movable furniture part always reaches the same first open position at the end of the closing process, it is necessary to define the opening angle of the ejection element in the first open position. The opening angle is achieved by a preferred design example in which at least one stop for the bearing element of the actuating pinion is arranged in the housing, whereby the bearing element rests on the stop in the first open position of the movable furniture part.

A further design example of the invention provides that the means to move the ejection element beyond the first open position is in the form of a preferably curved leaf spring whose first leg engages with the ejection element and whose second leg engages with the link element. In this case, the movable furniture part must be held against the force of the preferably curved leaf spring in its closed end position which can be achieved by a retracting device or a hinge.

According to another example, the means to move the ejection element beyond the first open position is in the form of a spiral spring whose first leg engages with the ejection element and whose second leg, preferably rotatable and held in position, engages with the housing. With an appropriate arrangement of the spiral spring, a form of snap mechanism can be produced such that the spiral or torsion spring holds the ejection element in the exit position but trips when unlatching the energy accumulator and forces the ejection element in the opening direction of the movable furniture part.

According to a further design example of the invention, the ejection device also has a release mechanism with a release element to unlatch the actuator. A preferred design example in this case provides that the release mechanism is configured for the release element to rest in direct contact on the movable furniture part or the furniture body in the closed position of the movable furniture part, in order to precisely define the release path.

Furthermore, it is intended to propose a process for opening and, as the case may be, closing a movable furniture part located in or on a furniture body of a furniture item using an ejection device which has an ejection element which is contacted, or can be contacted, by a latchable actuator, preferably a manually loaded energy accumulator. The latchable actuator is loaded during the closing movement of the movable furniture part by an ejection element which is characterised according to the invention in that the loading process of the energy accumulator is started, after the movable furniture part had been opened, beyond a first open position during a closing movement of the movable furniture part in a part section of the opening, or closing, path of the movable furniture part between the first open position and the closed end position.

In contrast to the state of the art, therefore, the loading process of the energy accumulator is begun right at the start of the closing movement of the movable furniture part whereby, according to a preferred design example of the invention, the loading process for the energy accumulator is started in general with each closing movement of the movable furniture part, preferably independent of the open position of the movable furniture part. In other words, the loading of the energy accumulator occurs based on the ratchet principle, i.e., after the end of the ejection process, the ejection element is free to move in relation to the energy accumulator during the further opening path while, in the reverse direction, it is in constant contact, in every position, with the energy accumulator.

BRIEF DESCRIPTION OF THE DRAWINGS

Other benefits and details of the invention are explained in more detail in the following description of the figures, referring to the design examples illustrated in the drawings, in which.

DETAILED DESCRIPTION OF THE INVENTION

Figure 1:
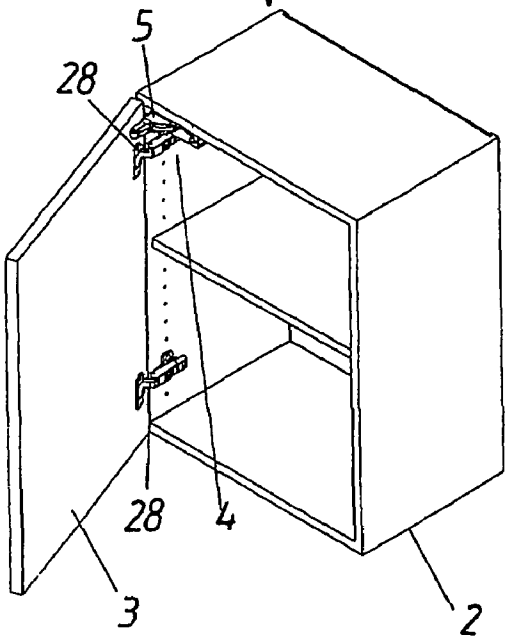
FIG. 1 show a first design example of a furniture item according to the invention with a movable hinged furniture part.

FIG. 1 shows a perspective view of the entire furniture item 1 according to the invention in which a movable furniture part 3 is arranged on a furniture body 2 so that it can rotate by means of two hinges 28. The ejection device 4 is arranged on the furniture body 2 inside, generally level with the front edge of the furniture body 2 such that the pivoted ejection element 5 can move the movable furniture part 3 in the opening direction.

Figure 2C:
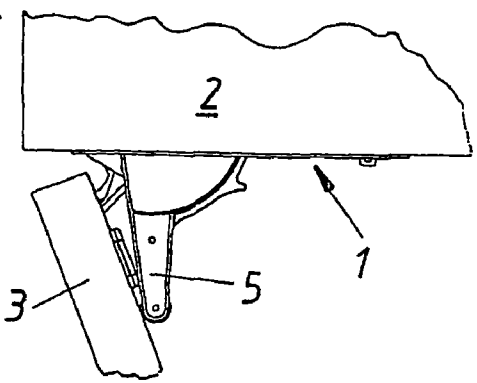
FIG. 2*a*-2*d* show in each case, the movable furniture part and the ejection element in different positions.
Figure 2A:
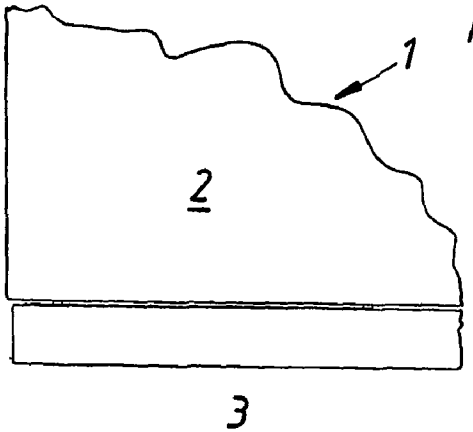

FIG. 2*a* shows a plan view of a detail of the furniture item 1 shown in FIG. 1 whereby the movable furniture part 3 is in its closed end position. The gap remaining between the furniture part 3 and the furniture body 2 is needed to allow the movable furniture part 3 to move from its closed end position to, as seen from the closing direction viewpoint, a released position after it whereby the latch on the actuator for the ejection element has been released. After the actuator is unlatched, the ejection element 5 forces the movable furniture part 3 to a first open position (FIG. 2*b*). At this point, the energy accumulator for the actuator has now completely discharged and the ejection element 5 had ended the ejection process. The reference symbol 26 indicates the release element of the ejection device, more of which will be explained later. Up to this point shown in FIG. 2*b*, the invention has followed the touch-latch operation principle known already in the state of the art.

The invention now takes over where the movable furniture part 3 is positioned as shown in FIG. 2*c*. As also happens with a conventional touch-latch mechanism, the opening of the movable furniture part 3 has to be done by the user beyond the open position shown in FIG. 2*b* since the ejection element 5 has already completed the ejection process. However, in the state of the art, the ejection element 5 does not change its location as the furniture part 3 moves beyond the first open position. The ejection device according to the invention has the means to move the ejection element 5 beyond the first open position shown in FIG. 2*b*.

Figure 2D:
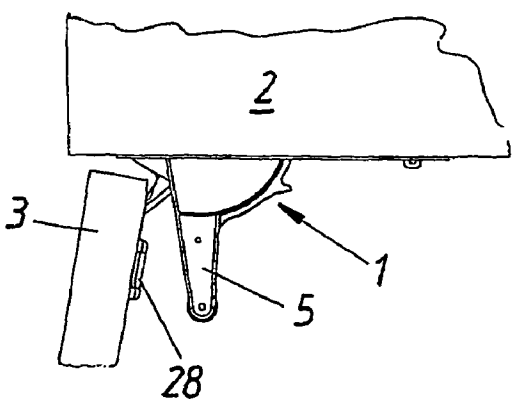
Figure 2B:
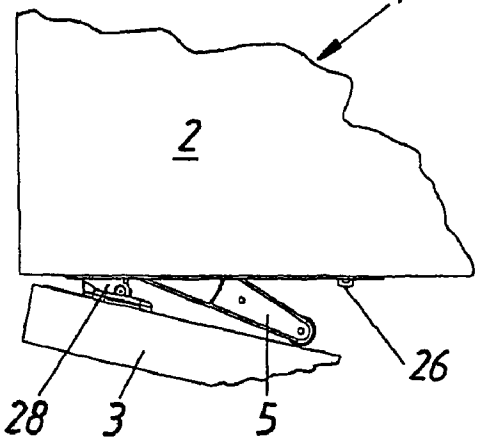

FIG. 2*d* shows both the movable furniture part 3 as well as the ejection element 5 in the completely open position whereby the condition where the ejection element 5 is no longer in contact with the movable furniture part 3 in the fully open position is simply a simplification of the design of the ejection device. Naturally it is also possible, however, to locate the ejection element 5 in the ejection device such that the ejection element 5 rests on the movable furniture part 3 in the fully open position.

Figure 3A:
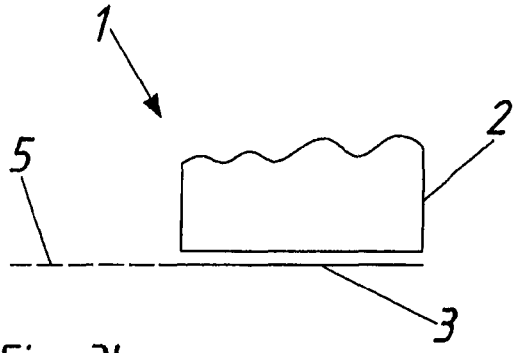
FIG. 3*a*-3*c* are diagrammatic representations of different positions of the movable furniture part.
Figure 3B:
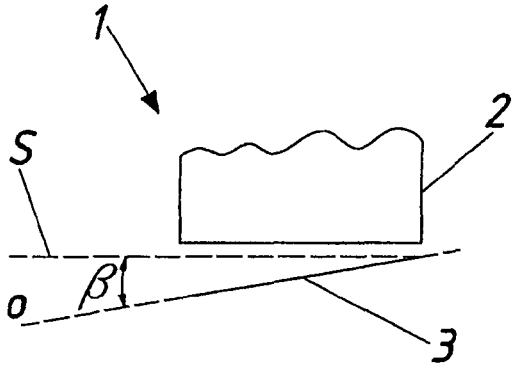
Figure 3C:
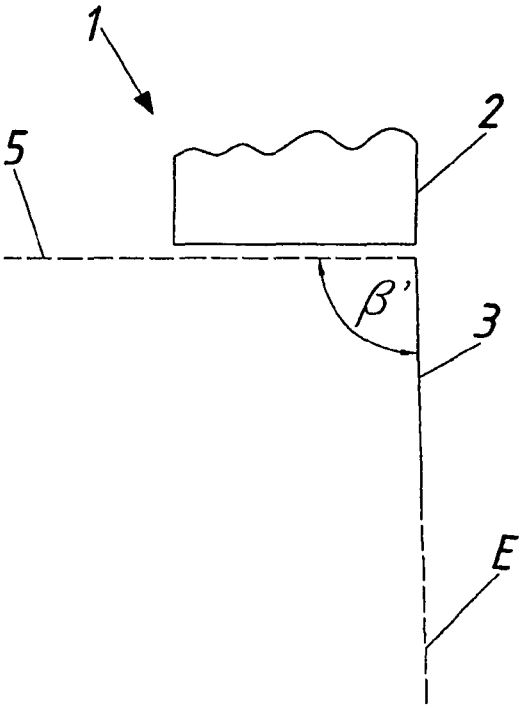

Different positions of the movable furniture part 3 are illustrated in FIGS. 3*a*-3*c*. Here, the movable furniture part 3 is shown in FIG. 3*a* in closed position S in which the movable furniture part 3 is aligned essentially parallel to the front of the furniture body 2. In FIG. 3*b*, the movable furniture part 3 is located in its first open position O corresponding to the position of the movable furniture part 3 after the end of the ejection process. The opening angle is designated by 13 which represents the change in position of the movable furniture part 3 from its closed position S to its first open position O. At the end of the ejection process, the movable furniture part 3 is moved by the user beyond the first open position O to its opened end position E. The opening angle β' extends in this case between the closed position S to the opened end position E of the movable furniture part 3.

It should be pointed out that the opened end position E does not necessarily have to be the completely open position of the movable furniture part 3—as shown in FIG. 3*c*—that is, the opening angle β' must simply be greater than the opening angle β in the closed position S of the movable furniture part 3 and smaller or equal to the maximum opening angle when the movable furniture part 3 is in its fully open position.

Figure 4A:
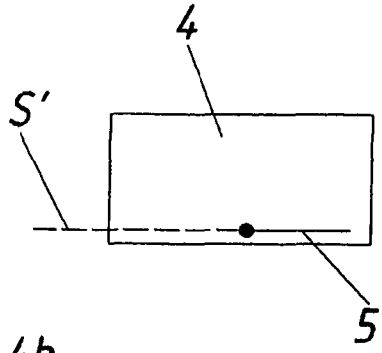
FIG. 4*a*-4*c* are diagrammatic representations of different positions of the ejection element.
Figure 4B:
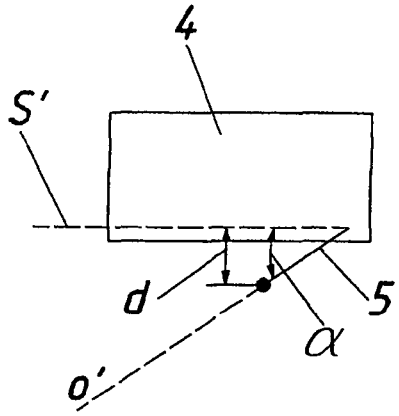
Figure 4C:
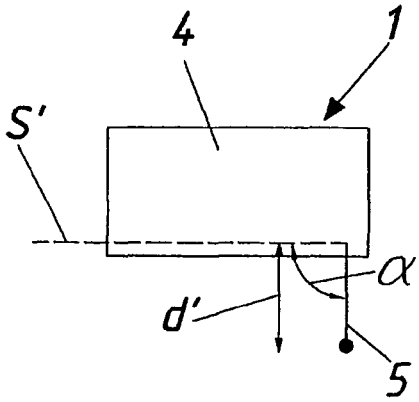

Similarly, FIGS. 4*a*-4*c* show different positions of the ejection element 5 which is pivoted in the ejection device 4 in the design example shown. FIG. 4*a* shows the ejection element 5 is the home position S' corresponding to the position of the ejection element 5 with a latched ejection device 4 and the movable furniture part 3 in the closed end position. FIG. 4*b* shows the position O' of the ejection element 5 after the end of the ejection process. The opening angle α here extends between the position O' of the ejection element 5 and the position of the ejection element 5 in the exit position S'. d is used to designate the distance between the contact point of the ejection element 5 in the closed position S' and the contact point of the ejection element 5 after the end of the ejection process, while d' denotes the distance between the contact point of the ejection element 5 in the closed position S' and the contact point of the ejection element 5 after the end of the opening process of the movable furniture part.

If FIGS. 4*b* and 4*c*, which show the position E' of the ejection element 5 after the end of the opening process of the movable furniture part 3, are compared, it can be seen that the distances d, d', or, respectively, the opening angles α, α' are different in both positions.

A basic idea of the invention consists of sending the ejection element 5, after the end of the ejection process, to, viewed in the opening direction, a position E' located beyond position O' which represents the position of the ejection element 5 after the end of the opening process of the movable furniture part 3. This is done by linking the movable furniture part 3 right at the start or immediately after the start of the closing process with the ejection element 5, whereby, with an appropriate linking of the ejection element 5 with the ejection device, the loading process for the energy accumulator can begin as early as the first section of the closing path, during which the loading of the energy accumulator can be completed using known devices in the part section of the closing path of the movable furniture part 3 immediately before the closed position.

This means that, essentially, the whole of the path traveled by the movable furniture part as it closes can now be used to load the energy accumulator. This is due to the invention and the construction of the ejection device using the ratchet principle such that the ejection element, at the end of the ejection process, is free to move in relation to the energy accumulator of the actuator during the further opening path, during which it is in constant contact, i.e., in every position, with the energy accumulator in the opposite direction. Thus, on the one hand, the path traveled by the movable furniture part as the energy accumulator is being loaded can be made greater than the path traveled by the movable furniture part during the ejection process, so that a user requires less force to load the energy accumulator due to the lengthened path.

A second possibility is to make the length of the path traveled by the movable furniture part during the charging and ejection processes essentially the same but to move this section to the immediate vicinity of the opened end position of the opening and closing path of the movable furniture part. The result of this is that the user will apply a force to load the energy accumulator right at the start of the closing process, giving the user the feeling of a smooth process when closing the movable furniture part.

Using two of the design examples presented in FIGS. 6*a*-15 and FIGS. 16*a*-28, the functioning sequence of a furniture item according to the invention during the opening and closing processes will be described below.

Figure 5A:
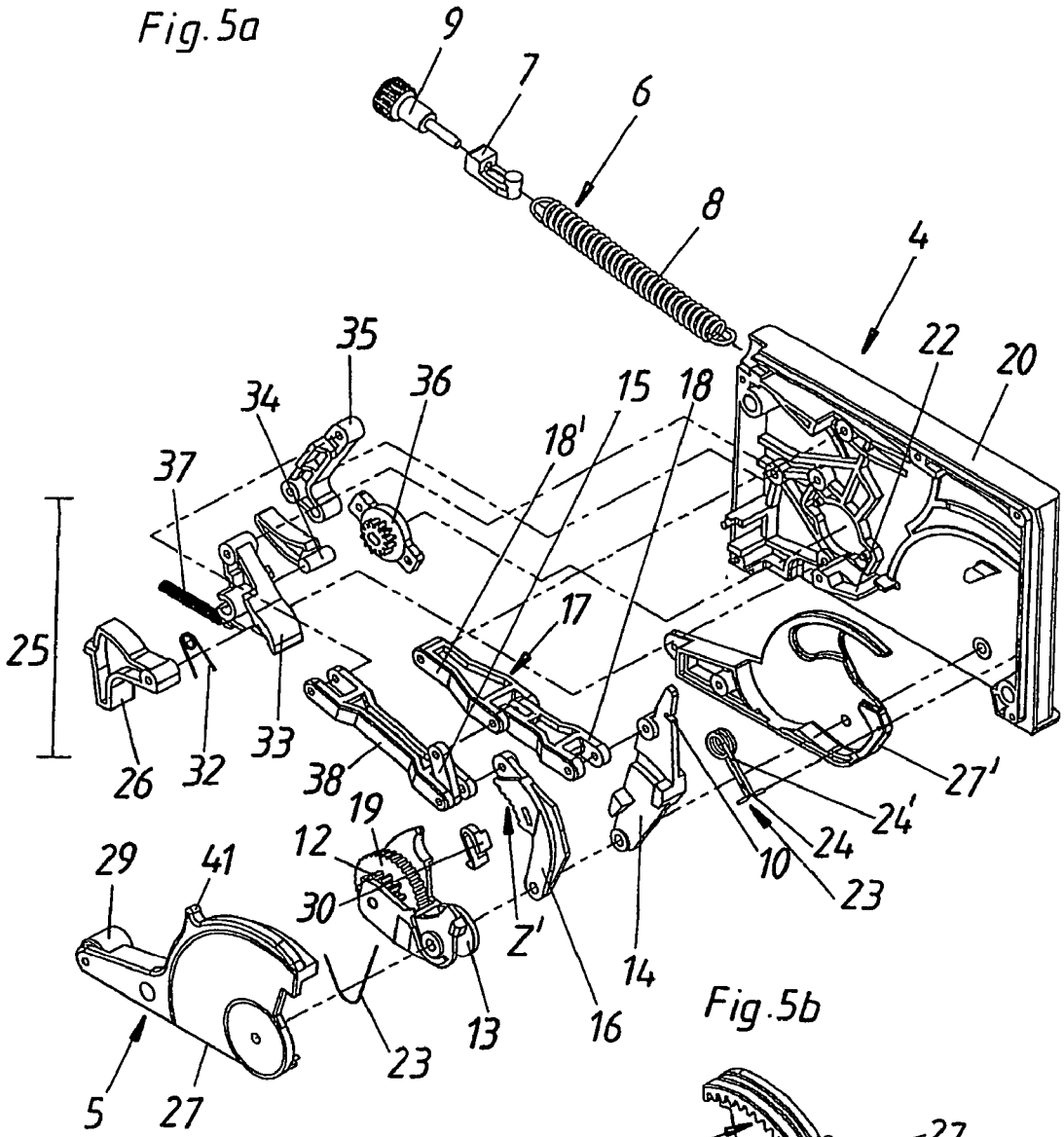
FIG. 5*a* is an exploded view of a preferred example of an ejection device according to the invention.

FIG. 5*a* shows an exploded view of a first example of an ejection device 4 according to the invention. All parts of the inventive ejection device 4 are arranged in an enclosed housing 20, whereby the housing cover is not shown to allow a clear overall view. The rotatable ejection element 5 arranged in the housing 20 is in the form of a single-arm lever and has an upper part 27 and a lower part 27'. A rotatable roller 29 is arranged on its end furthest from the pivot point, whereby the axes of rotation of the roller 29 and the ejection element 5 are essentially parallel. This roller 29 provides the means of linking the ejection element 5 with the movable furniture part.

Figure 5B:
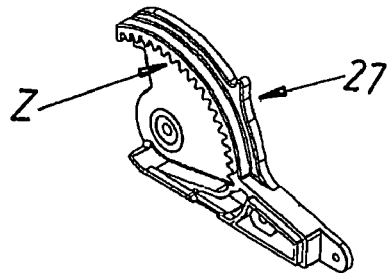
FIG. 5*b* is a rear view of the upper part of the ejection element from FIG. 5*a*, FIG. 6*a*-15 show different positions of the movable furniture part and the ejection device from FIG. 5*a* during opening and closing the movable furniture part.

A bearing element 13, a coupling element 16 and a link element 14 are also rotatable and arranged coaxially with the ejection element 5 between the lower part 27' and the upper part 27. A pinion 12 and a brake disk 19, connected together and unable to rotate relative to each other, are anchored and can rotate about an axis which is essentially parallel to the rotation axis of the ejection element 5 or, respectively, that of the bearing element 13. The pinion 12 is constructed so that it engages with a toothed section Z (FIG. 5*b*) on the upper part 27 of the ejection element 5, while the brake disk 19 is constructed to engage with a toothed section Z' arranged on the coupling element 16. Furthermore, a guide element 30 is arranged between the coupling element 16 and the brake disk 19, and the guide element 30 serves to provide a secure engagement with the teeth in the toothed section Z' of the coupling element 16 arranged around the perimeter of the brake disk 19 (i.e., this prevents a tooth tip on the brake disk 19 from coming into contact with a tooth tip on the toothed section Z' on the coupling element 16 when the brake disk 19 engages with the coupling element 16).

In the example shown, the means to move the ejection element 5 through a first open position comprise two auxiliary actuators 23, 23' whereby the first auxiliary actuator 23' in the form of a spiral spring bears on the bearing element 13 in the opening direction, whose movement is restricted by a stop 22 arranged in the housing, which allows the required freedom of movement for the ejection element 5 between the brake disk 19 and the coupling element 16. The second auxiliary actuator 23' is in the form of a torsion spring whose first leg 24 engages with the upper part 27 of the ejection element 5 while the second leg 24' is rotatable but fixed in position to the housing 20 of the ejection device 4.

Furthermore, the actuator 6 for the ejection element 5 is arranged in the ejection device 4, where the actuator 6 has a manually loaded energy accumulator 8 in the form of a tension spring, a retainer 7 for the energy accumulator 8 and an adjusting element 9 to adjust the energy accumulator 8. The adjusting element 9 is arranged in the housing 20 such that it is accessible externally to make adjustment of the energy accumulator 8 simple and uncomplicated. At its open end, the energy accumulator 8 constructed as a tension spring for the actuator 6 is hooked over a projection 10 on the link element 14, so that, as the energy accumulator 8 discharges, the link element 14 is moved in the direction of the actuator 6.

The actuator 6 is latched, in the design example shown, by an elbow lever 17 and a dead point mechanism. In this system, the first arm 18 of the elbow lever 17 is pivoted at its free end with the link element 14, while the second arm 18' is pivoted to the housing 20 of the ejection device 4. The dead point mechanism comprises a pivoted lever 15 and is connected at one end to the elbow of the elbow lever 17 and at the other end, also pivoted, to the coupling element 16. The actuator 6 is latched, when charging the energy accumulator 8 by the ejection element 5, when the link element, due to its engagement with the brake disk 19 and with the coupling element 16 of the link element 14 is moved so far to the right until the energy accumulator 8 is fully loaded and the lever 15 crosses the dead point of the elbow lever 17, which latches the elbow lever 17, and, therefore, the link element 14.

The actuator 6 is unlatched by a release mechanism 25 which comprises a release element 26, an eccentric rotating element 33, a restoring spring 32 for the rotating element 33, a wedge-shaped adjusting element 34, a release lever 35, a damping element 36 and a restoring element 37, contacted by the damping element 36, to restore the rotating element 33. The release mechanism 25 is linked to the lever 15 of the dead point mechanism by a connecting part 38, preferably in the form of a lever, which can rotate at one end with the release lever 35 and at the opposite end with the lever 15 of the dead point mechanism, or, respectively, the coupling element 16.

Figure 6A:
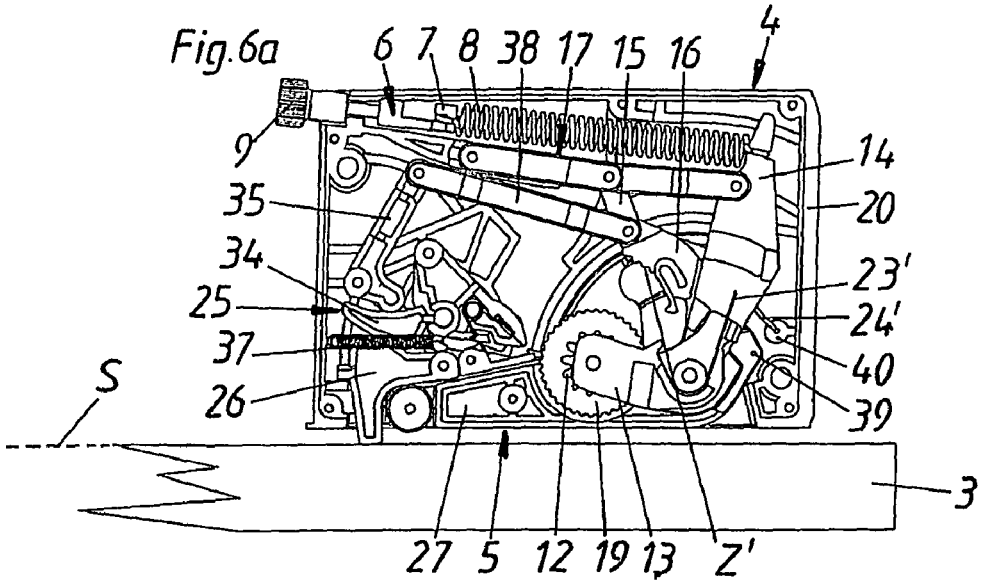

FIG. 6*a* shows the ejection device 4 with the energy accumulator 8 in the latched condition. The movable furniture part 3 is in the closed position whereby the release element 26 of the release mechanism 25 rests directly on to the movable furniture part 3. More will be explained later about the direct contact of the release element 26 with the movable furniture part 3 which is essentially accomplished by means of the wedge-shaped adjusting element 34 which is contacted by the restoring element 37.

The view of the device is clarified by omitting the cover of the housing 20 and the upper part 27 of the ejection element 5 from the drawing. In the situation shown, the energy accumulator 8 for the actuator 6 is loaded. This means that the tension spring which constitutes the energy accumulator 8 is anchored in the retainer 7 and tensioned by the link element 14. On its front side facing the movable furniture part 3, the housing 20 has an exit aperture 21 for the ejection element 5 and the release element 26. All of the remaining components of the ejection device 4 are contained inside the enclosed housing 20 except the adjusting element 9 for the energy accumulator 8.

The energy accumulator 8 is latched by means of an elbow lever 17 acting on the link element 14 where the lever 17 is latched in the position shown by a lever 15 in a dead point mechanism. The ejection element 5 is latched in its home position S' by the auxiliary actuator 23 constructed as a torsion spring. In this, the auxiliary actuator 23 is arranged such that the one leg 24' of the spring is arranged in a bearing point 40 in the housing and the second leg 24 of the auxiliary actuator 23 is arranged in a bearing point 39 on the lower part 27' of the ejection element 5 so that they swivel.

By locating the bearing point 39, with the ejection element 5 in the home position, on the right side of the connecting line V of the pivot point of the ejection element 5 and the bearing point 40 (FIG. 6*b*), this ensures that the auxiliary actuator 23 locks the ejection element 5 in its home position. Due to the rotational motion of the ejection element 5 during the ejection process this bearing point 39 moves to the left until it crosses the connecting line V, so that the auxiliary actuator 23 pushes the ejection element 5 in the opening direction. This means that the auxiliary actuator 23 constructed as a torsion spring is latched, similar to the actuator 6, by means of a dead point mechanism.

In the position shown, therefore, the link element 14, the coupling element 16 and the ejection element 5 are not free to move due to the latched elbow lever 17 or, respectively, the position of the auxiliary actuator 23, while the bearing element 13 and, thus, the pinion 12 and the brake disk 19 can rotate. In this, the bearing element 13 is contacted by an auxiliary actuator 23' formed as a curved spring which forces the bearing element in the opening direction of the movable furniture part whereby the teeth on the pinion 12 engage with the tooth-shaped section Z of the upper part 27 of the ejection element 5.

By having the bearing element 13 forced away from the coupling element 16 by the auxiliary actuator 23', the required freedom of movement can be obtained between the coupling element 16 and the brake disk 19 during the opening process. If this brake disk 19 were to engage with the tooth-shaped section Z' of the coupling element 16 during the opening process, this would block the pinion 12 and, thus, the ejection element 5 as a result, that is, the ejection of the movable furniture part 3 by the ejection element 5 would not have been possible in this type of configuration.

Figure 6B:
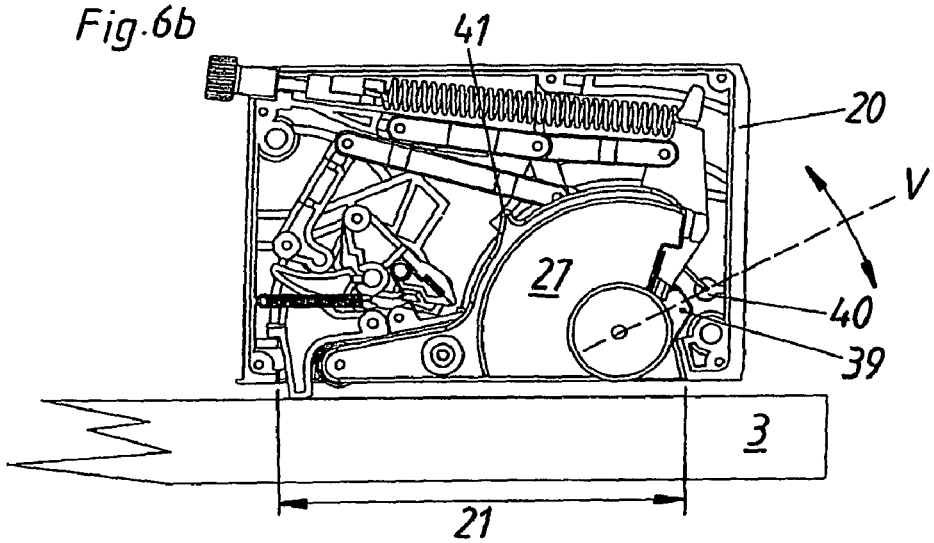

FIG. 6*b* differs from FIG. 6*a* in that it shows the upper part 27 of the ejection element 5, on which a catch 41 is formed.

Figure 7:
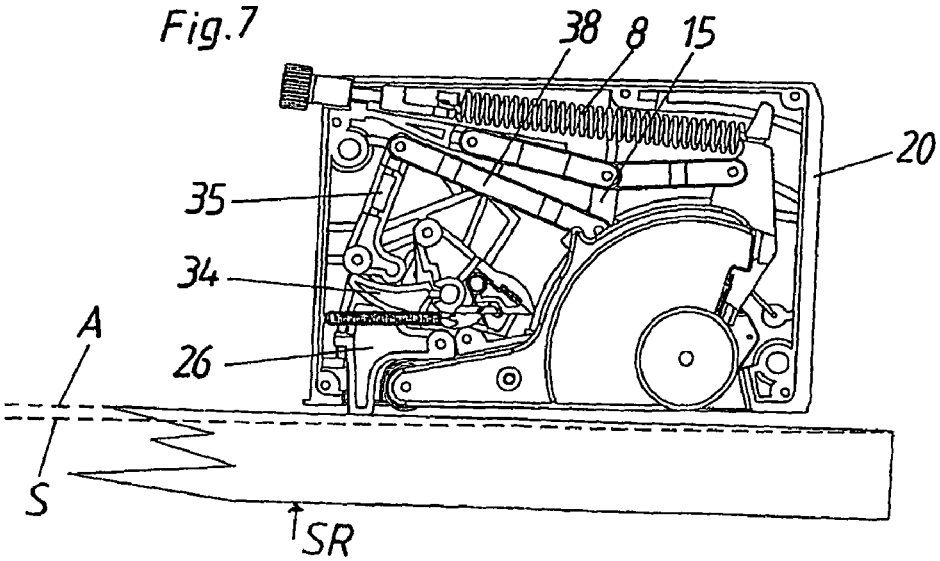

FIG. 7 shows the movable furniture part 3 in the release position A which, viewed in the closing direction SR, is located beyond the home position S of the movable furniture part 3, whereby the movable furniture part 3, in the design example shown, is being moved by the user who is pressing the movable furniture part from the home position S to the release position A. The motion of the movable furniture part 3 pushes the release element 26 back into the housing 20 and the release lever 35 moves leftwards over the wedge-shaped adjusting element 34. The release element 26, the wedge-shaped adjusting element 34 and the release lever 35 are thus constructed and arranged as components in a rolling contact joint. The L-shaped lever 35 and the lever-type link 38 also move the lever 15 in the dead point mechanism to the left which releases the catch on the elbow lever and, thus, the latching of the energy accumulator 8.

Even though the illustrated release mechanism represents a preferred design example, the invention is not to be seen as restricted to the design example shown. To this end, instead of using the movable furniture part 3 to release the ejection device, it is completely possible and conceivable to do this by means of a switch, a button or by direct pressure on the release element 26 itself.

Figure 8:
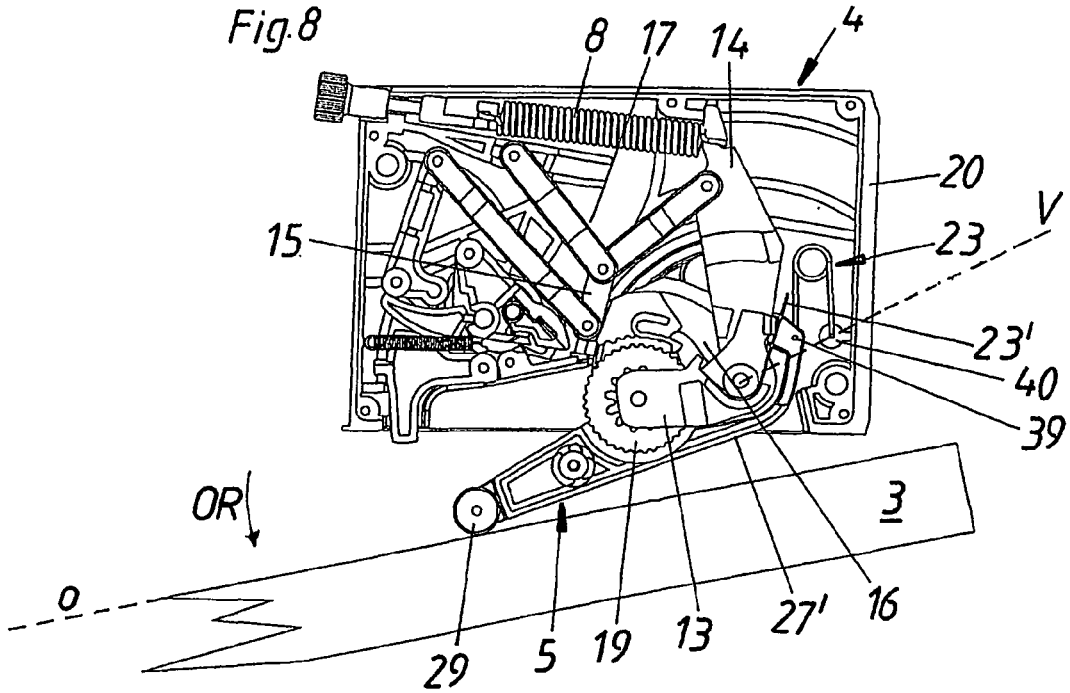

In FIG. 8, the ejection process has ended and the movable furniture part 3 has reached its first open position O. With the release of the energy accumulator 8, the link element 14 was moved to the left which moved the ejection element 5 out of the housing 20 in the opening direction OR. The link between the ejection element 5 and the movable furniture part 3 is made by means of the idler roller 29, which allows the movable furniture part 3 to slide smoothly on the ejection element 5. The coupling element 16 was also moved in the opening direction OR by the lever 15 which is connected at one of its ends to the elbow of the kinked elbow lever 17, the movement continuing until a gap appears between the brake disk 19 and the toothed section Z' of the coupling element 16, or, respectively, the guide 30, so that the pinion 12 which is still engaging with the toothed section Z on the upper part 27 of the ejection element 5 (not shown) is allowed to turn.

The bearing element 13, still being forced by the auxiliary actuator 23' in the opening direction OR, is prevented from moving further outwards by the stop 22 (FIG. 5*a*) arranged in the housing 20.

It is further evident from FIG. 8 that the bearing element 39 for the leg 24 of the auxiliary actuator 23 formed as a torsion spring, lies between the pivot point of the ejection element and the bearing point 40 of the auxiliary actuator 23 so that the auxiliary actuator 23' is still forcing the ejection element 5 in the opening direction OR. This requires the force exerted by the auxiliary actuator 23 to be arranged such that it can just move the ejection element 5 out, but is not enough for the ejection element 5 to open the movable furniture part 3 further, which is still in contact with the ejection element 5.

It is, of course, also possible to make the acting force of the auxiliary actuator 23 so large that the auxiliary actuator 23 would not only be able to move the ejection element 5 but also the movable furniture part 3 beyond the first open position O to an opened end position E. A construction of this type would lead to the situation where the user, in closing the movable furniture part 3, would have to apply, additional to the force to load the energy accumulator 8, the relatively large force to load the auxiliary actuator which would give the user the impression of a movable furniture part which is stiff to move. Nevertheless, if the level of the acting force by the auxiliary actuator 23 is appropriate, a furniture item 1 with a movable furniture part 3 and an ejection device 4 can be produced where the user, in moving the movable furniture part 3 from a closed position to an opened end position, simply has to release the ejection device 4 by, for instance, applying pressure to the movable furniture part whereby the movable furniture part 3 would then be moved in a first section by the ejection element 5 and in a further section by the auxiliary actuator 23 to its opened end position without requiring any further action on the part of the user.

By contrast, in the example shown, the force exerted by the auxiliary actuator 23 is just enough for the ejection element 5 to stay in contact with the movable furniture part 3 such that the user is scarcely aware, when closing the movable furniture part, of the force applied to load the auxiliary actuator 23.

Figure 9:
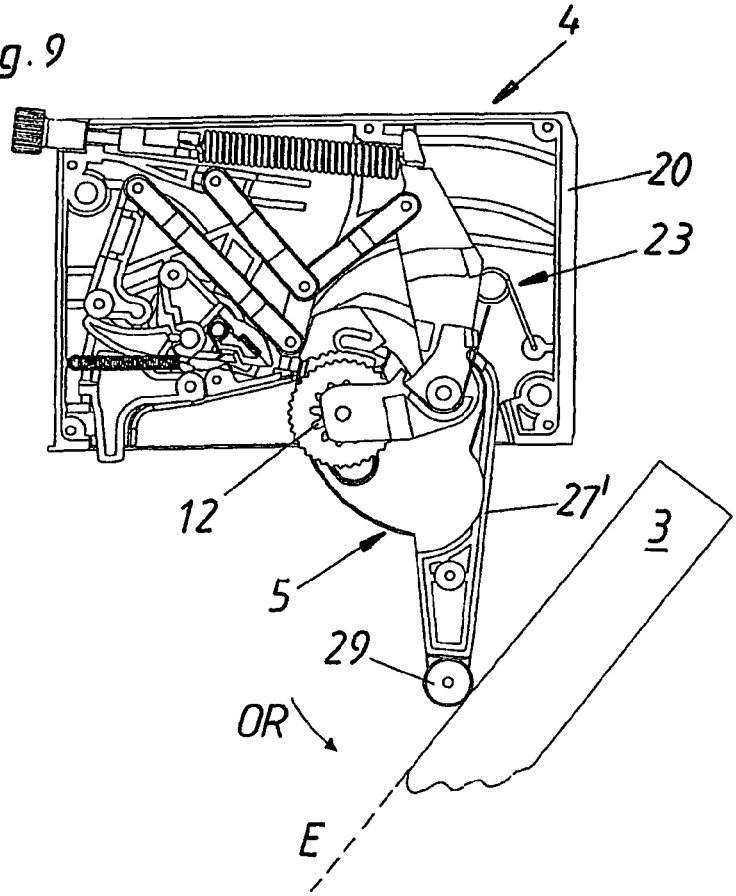

An opened end position E of the movable furniture part 3 is illustrated in FIG. 9. It is evident that, compared with FIG. 8, the position of the movable furniture part 3, the ejection element 5 and the auxiliary actuator 23 has changed. The discharging of the auxiliary actuator 23 and the movement of the movable furniture part 3 by the user to an opened end position E has enabled the ejection element 5 to follow the movement of the movable furniture part 3. Similarly, the position of the pinion 12 has changed relative to the toothed section Z arranged on the upper part 27 of the ejection element 5. In other words, the pinion 12 on this toothed section Z is now engaged with a point on the toothed section Z furthest from the idler roller 29.

Figure 10:
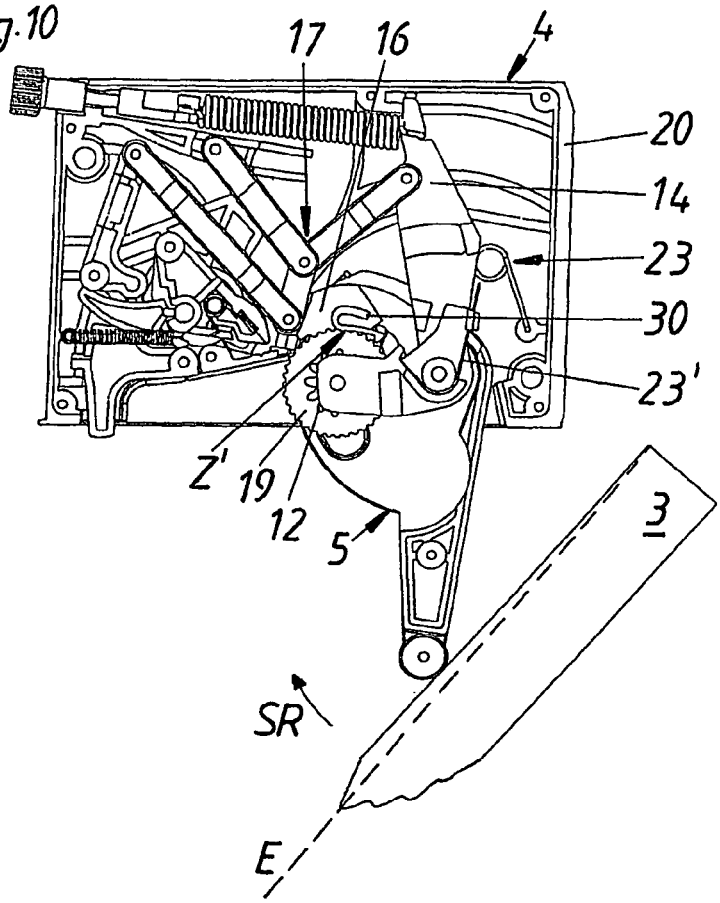

If the movable furniture part 3 is now moved from its opened end position E in the closing direction SR, the brake disk 19 is brought into engagement with the toothed section Z' of the coupling element 16, as shown in FIG. 10. This will block the rotation of the pinion 12 along the toothed section Z on the ejection element 5 and the coupling element 16 will be forced back in the closing direction into the housing 20 by the movement of the ejection element 5. The link element 14 is moved so far to the right by the coupling element 16 and the elbow lever 17 linked to it until the energy accumulator 8 of the actuator 6 is fully loaded. At the same time, this movement also loads the auxiliary actuators 23, 23' (FIG. 11*a*).

As shown in FIG. 10, the action of the guide 30 ensures that the brake disk 19 and the toothed section Z' of the coupling element 16 engage with each other such that each tooth tip of the brake disk 19 engages with each tooth root on the toothed section Z' of the coupling element 16 which is able to prevent any jerky movements of the ejection element 5 and, thus, of the movable furniture part 3.

Figure 11A:
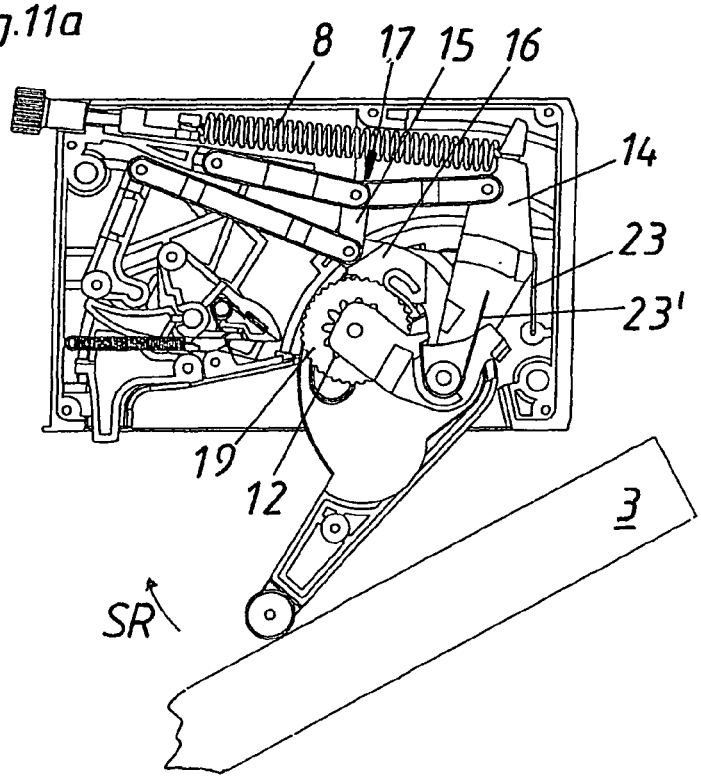
Figure 11B:
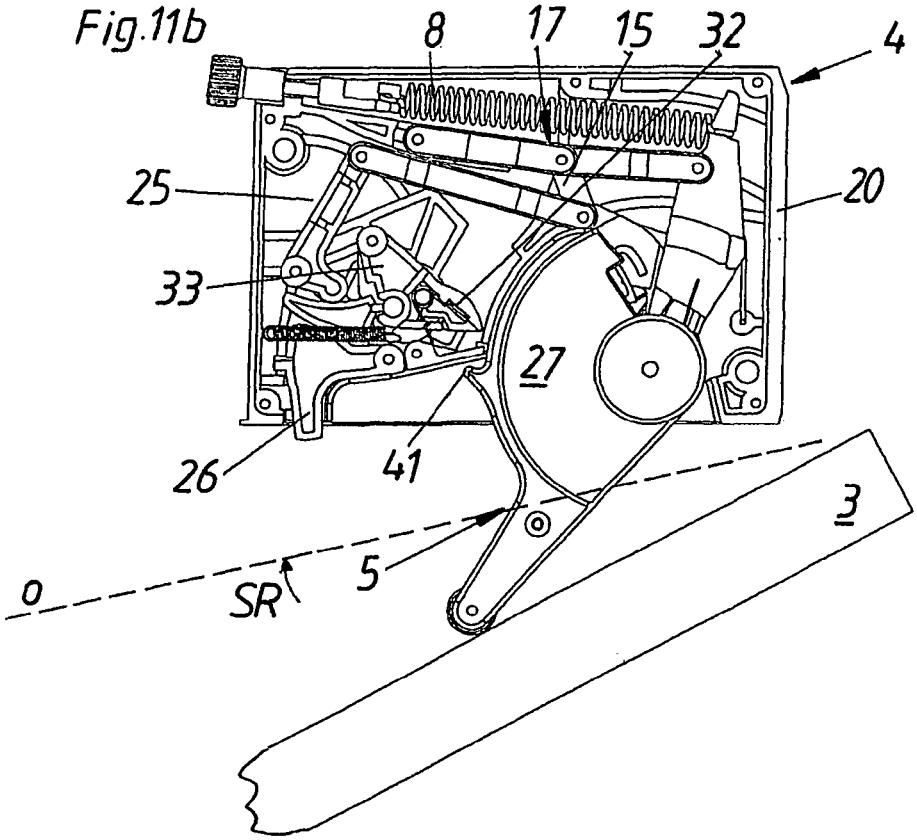

FIG. 11*b* differs from FIG. 11*a* in that the lever 15 of the dead point mechanism has now passed beyond the dead point of the elbow lever 17 so that the energy accumulator 8 of the actuator 6 is latched. Thus, the loading process for the energy accumulator 8 is concluded before the movable furniture part 3 has reached its first open position O. After the energy accumulator 8 has been loaded, the release element 26 of the release mechanism 25 remains in contact, with no play, with the movable furniture part 3 during the remaining section of its closing path.

Moreover, as can be seen in FIG. 11*b*, the upper part 27 of the ejection element 5 has a catch 41 which is formed to engage with an eccentric rotating element 33 of the release mechanism 25. The rotating element 33 is forced in the closing direction SR of the ejection element 5 by a restoring spring 32 to ensure that the catch 41 engages with the rotating element 33 as the ejection element 5 retracts into the housing 20.

Figure 12:
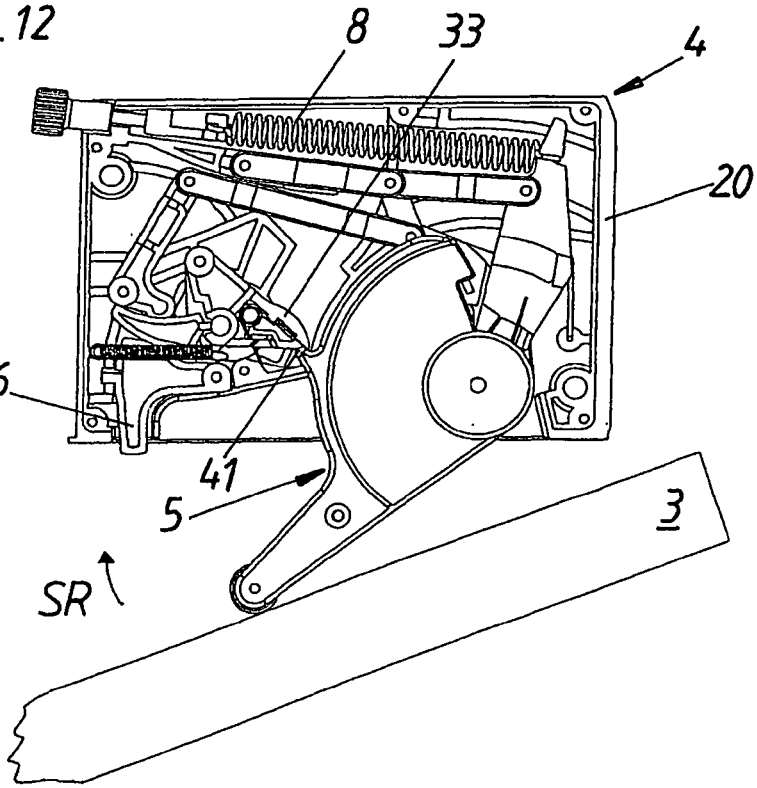

In FIG. 12, the catch 41 is now engaged with the eccentric rotating element 33, and carries it along with it in the closing direction SR of the ejection element 5. As the ejection element 5 retracts, the locking elements of the ejection device 4 remain unchanged for the energy accumulator 8, thus keeping the actuator latched.

Figure 13:
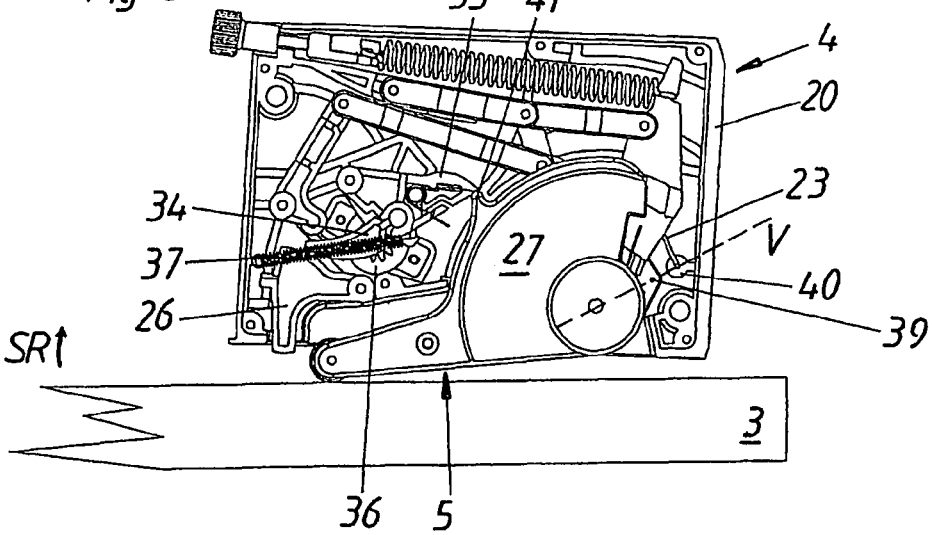

In FIG. 13, the bearing point 39 of the auxiliary actuator 23 has now passed beyond the connecting line V between the pivot point of the ejection element 5 and the bearing point 40 of the auxiliary actuator 23 on the housing 20, whereby the auxiliary actuator 23 continues to press on the ejection element 5 in the opposite direction, that is, the ejection element 5 is now pushed back into its home position by the auxiliary actuator 23 where it is latched. The catch 41 on the ejection element 5 has restored the rotating element 33 to an end position which has tensioned the restoring element 37 completely. The eccentric rotating element 33 is connected via a toothed section (not shown) to the pinion of a damper 36 to dampen the return movement of the rotating element 33 when tensioning the restoring element 37 in the form of a tension spring, as well as avoiding noise which might arise as the rotating element 33 returns to its other end position. By locating the wedge-shaped adjusting element 34 in a ball socket arranged on the eccentric rotating element 33 by means of a ball head, the wedge-shaped adjusting element 34 is moved in conjunction with the eccentric rotating element 33.

Figure 14:
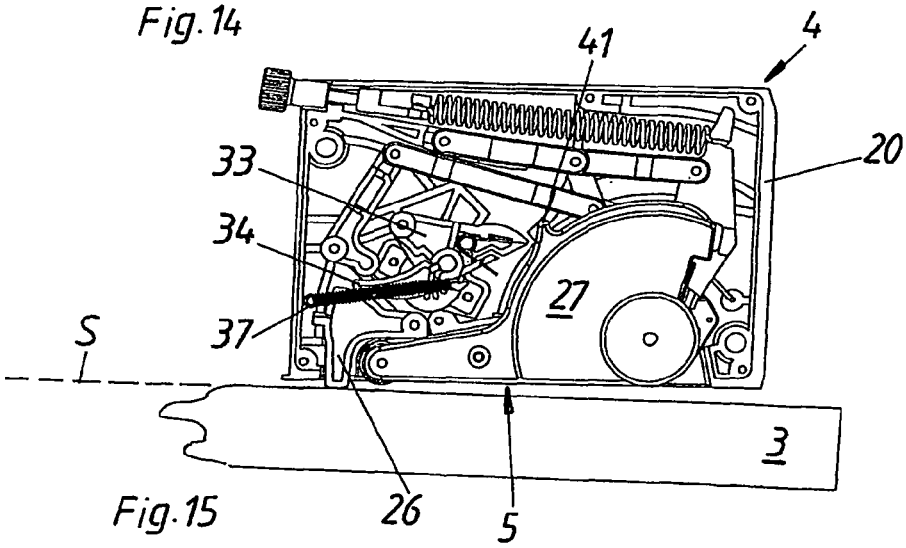

In FIG. 14, the movable furniture part 3 is now back in its closed position S, in which, for example, it can be retained by the hinge 28. The catch 41 on the ejection element 5 now snaps past the eccentric rotating element 33 which is moved to the left by the restoring element 37. The rotating element 33 moves the wedge-shaped adjusting element 34 to the left also. Due to the rolling contact joint formed between the wedge-shaped adjusting element 34 and the release element 26, the release element 26 is moved out of the housing 20 towards the movable furniture part 3 and just far enough so that the release element 26 rests on the movable furniture part 3 with no play between them (FIG. 15).

Figure 15:
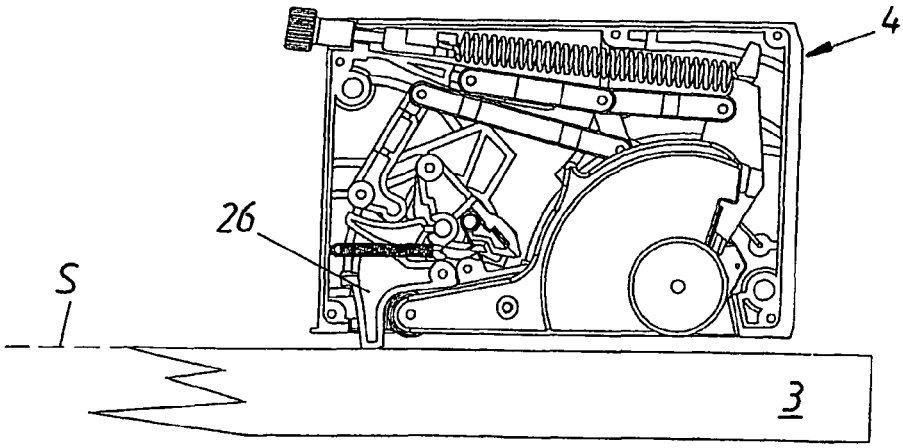

The configuration shown in FIG. 15 corresponds to that shown in FIG. 6*b*, that is, the ejection element 5 is in the home position, with the actuator 6 latched, the movable furniture part 3 is in the closed position and the release element 26 rests on the movable furniture part 3 with no play between them.

Figure 16A:
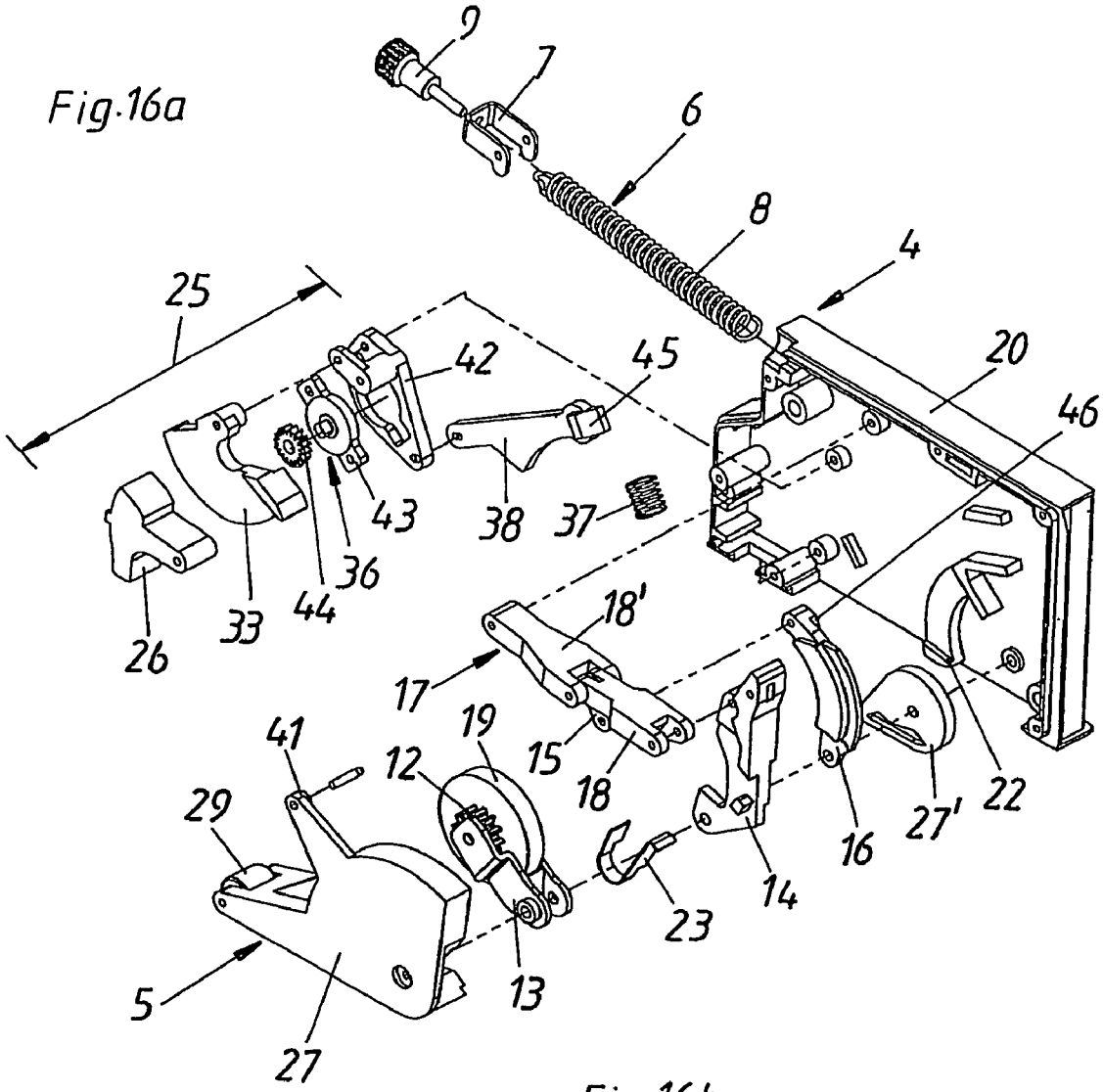
FIG. 16*a* is an exploded view of a second example of an ejection device according to the invention.
Figure 16B:
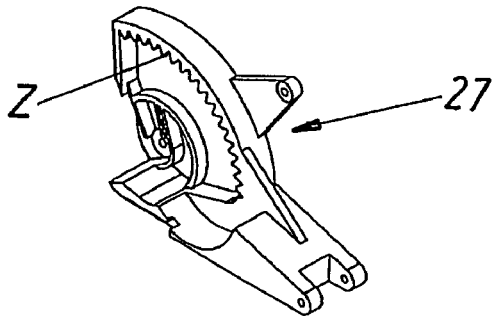
FIG. 16*b* is a rear view of the upper part of the ejection element from FIG. 16*a* and FIG. 17-28 show different positions of the movable furniture part and the ejection device from FIG. 16*a* during opening and closing the movable furniture part.

FIG. 16*a*, as in FIG. 5*a*, shows an exploded view of a second example of an inventive ejection device 4. The same parts have the same identification symbols, so a repeat description of these parts will be dispensed with.

The second example shown in FIGS. 16*a*-28 differ from the first design example shown in FIGS. 5*a*-15 mainly in the design of the release mechanism 25 and its linking with the coupling element 16 via the lever-type link 38.

As in the first example, the release mechanism 25 has a release element 26, an eccentric rotating element 33 and a damper 36, whereby the damper 36 comprises a bearing 42, a rotary damper 43 and a pinion 44. Differing from the first design example, the release element 26 in the second design example is connected directly to the eccentric rotating element 33 via a rolling contact joint. The release mechanism 25 is connected to the coupling element 16 via a lever-type link 38 which, however, is pivoted at one of its ends to the bearing 42 on the damper 36. This means that the bearing 42, or rotating damper 43 respectively, in the second design example assumes the function of the release lever 35, or restoring element 37 respectively, in the first design example.

The lever-type link 38 is no longer pivoted at its opposite end with the coupling element 16. Instead, a notched end 45 is arranged at the free end of the lever-type link 38 which is formed to engage with a projection 46 formed on the coupling element 16. The coupling element 16, for its part, is pivoted with the lever 15 of the dead point mechanism for the elbow lever 17.

In contrast to the first example, the second design example has just one auxiliary actuator 23, formed as a curved spring and acting between the link element 14 and the ejection element 5. The difference extends to the construction of the peripheral surface of the brake disk 19 and the corresponding section Z' on the coupling element 16.

Whereas in the first example engagement between the brake disk 19 and the coupling element 16 was positive due to the toothed design, in the second example the brake disk 19 and the coupling element 16 form a friction contact with one another.

Figure 17:
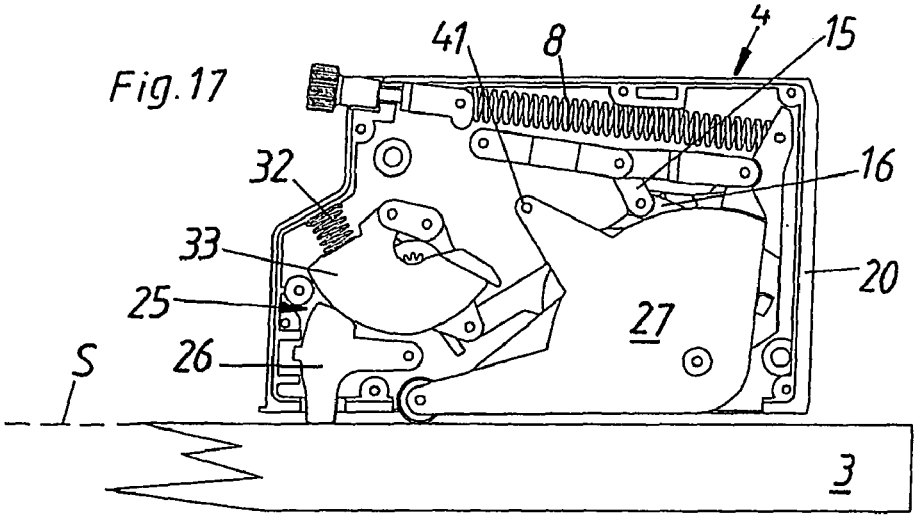

FIG. 17 shows the ejection device 4 with the energy accumulator 8 latched. The movable furniture part 3 is in the closed position S whereby the release element 26 of the release mechanism 25 rests on the movable furniture part 3 with no play between them. In the position shown, the energy accumulator 8 is loaded and the actuator 6 latched. The latch action is brought about by the action of an elbow lever 17 on the link element 14, where the lever 17 is locked by a lever 15 in a dead point mechanism in the position illustrated.

The ejection element 5 is locked in its home position S by the hinge 28. The link element 14, the coupling element 16 and the ejection element 5 are not free to move due to the locked elbow lever 17 and the movable furniture part 3 held in its closed position by the hinge 28, while the bearing element 13 and, thus, the pinion 12 as well as the brake disk 19 can rotate. The freedom of movement required for free motion between the coupling element 16 and the brake disk 19 is provided by simply having a stop 22' for the bearing element 13 in the housing 20.

In this example, it must be ensured that the retention force of the hinge is greater than the force exerted by the auxiliary actuator 23 which maintains the ejection element 5 in permanent contact in the opening direction OR with the movable furniture part 3.

Figure 18:
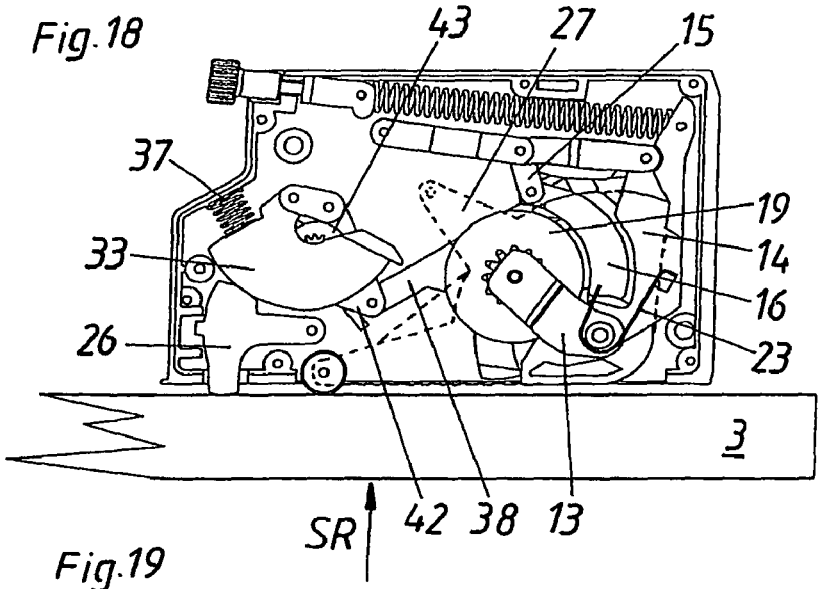

FIGS. 18 and 18*b* differ only in that the upper part 27 of the ejection element 5 is shown transparently (dotted line). Otherwise, pressure is being exerted in FIG. 18 on the movable furniture part 3, denoted by the changed position of the release lever 15.

Figure 19:
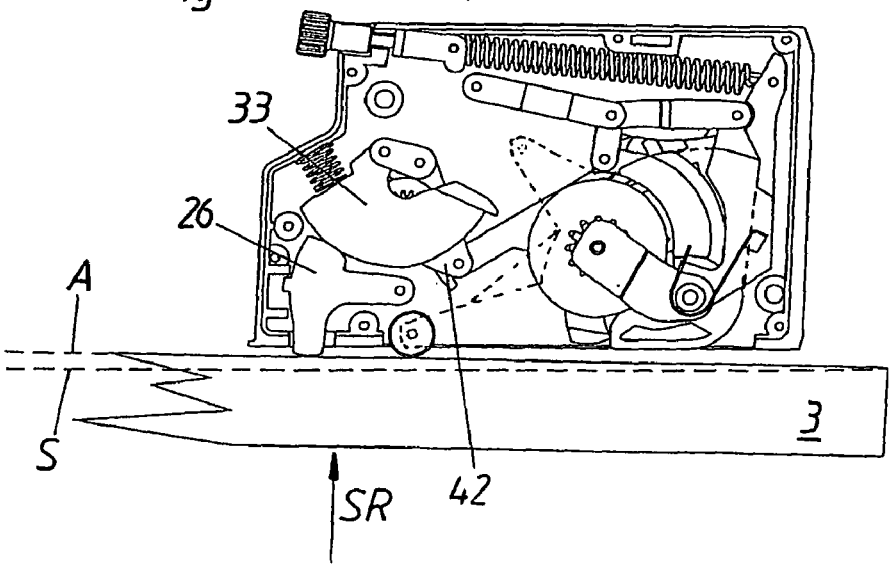

FIG. 19 shows the movable furniture part 3 in the release position A which, viewed in the closing direction SR, is located behind the closed position S of the movable furniture part 3, whereby the user is applying pressure to move the movable furniture part 3 from the closed position S to the release position A. The movable furniture part 3 pushes the release element 26 further back into the housing 20 whereby, via the rolling contact joint, the eccentric rotating element 33 and, with it, the bearing 42, are moved to the left. Simultaneously, the coupling element 16 and, therefore, the lever 15 in the dead point mechanism are also moved to the left by the notched end 45 (FIG. 16*a*) arranged on the lever-type link 38, unlatching the elbow lever 17 and so unlatching the energy accumulator 8.

Figure 20:
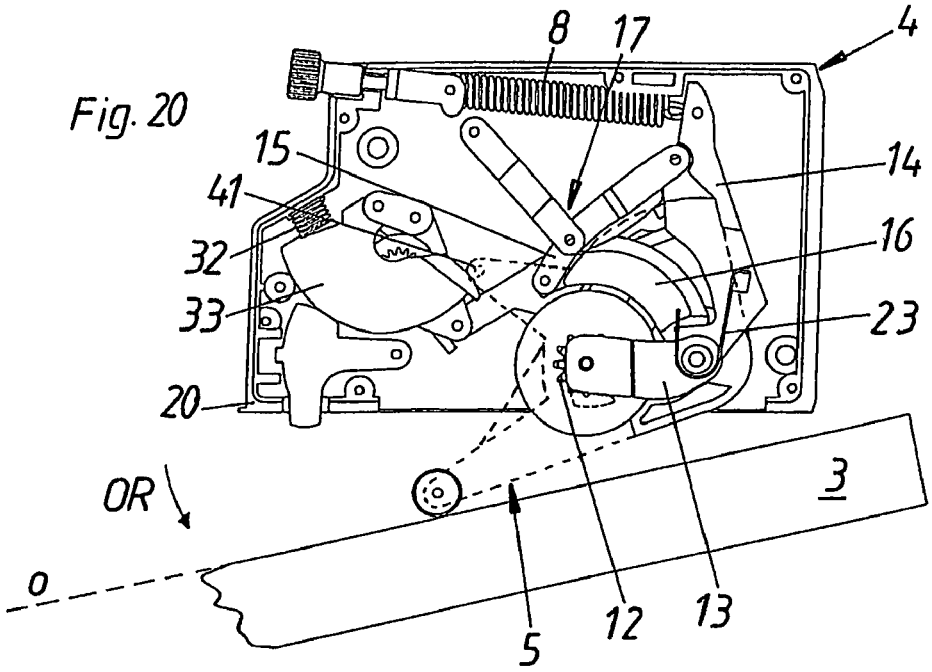

In FIG. 20, the ejection process has ended and the movable furniture part 3 has reached its first open position O. With the release of the energy accumulator 8, the link element 14 was moved to the left which moved the ejection element 5 out of the housing 20 in the opening direction OR. The link between the ejection element 5 and the movable furniture part 3 is made by means of the idler roller 29, which allows the movable furniture part 3 to slide smoothly on the ejection element 5. The bearing element 13 is prevented from moving further outwards by the stop 22 (FIG. 16*a*) arranged in the housing.

In order to allow the eccentric rotating element 33 which, during the opening process is moved to the left by the catch 41 on the ejection element 5, to return to a position once the catch 41 has passed, in which the catch 41 can again engage with the eccentric rotating element 33 when closing the movable furniture part 3, a restoring spring 32 in the form of a compression spring is arranged between the housing 20 and the eccentric rotating element 33.

Figure 21A:
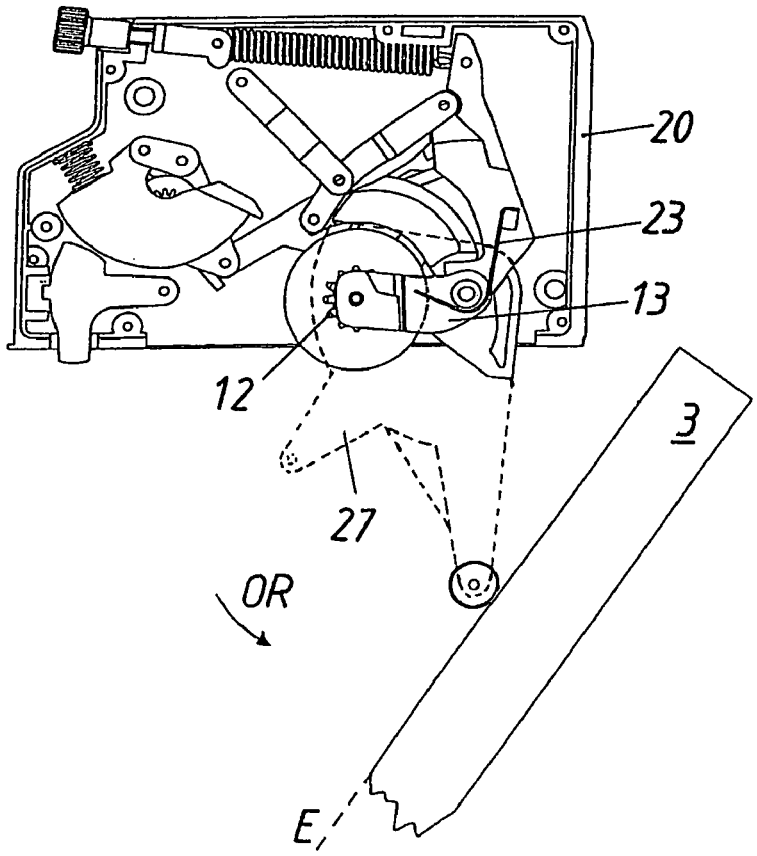

An opened end position E of the movable furniture part 3 is illustrated in FIG. 21*a*. It is evident that, compared with FIG. 21*a*, the position of the movable furniture part 3, the ejection element 5 and the auxiliary actuator 23 has changed. The movement of the movable furniture part 3 by the user to an opened end position E has enabled the auxiliary actuator 23 to discharge and the ejection element 5 to follow the movement of the movable furniture part 3. Similarly, the position of the pinion 12 has changed relative to the toothed section Z arranged on the upper part 27 of the ejection element 5. In other words, the pinion 12 on this toothed section Z is now engaged with a point on the toothed section Z furthest from the idler roller 29.

Figure 21B:
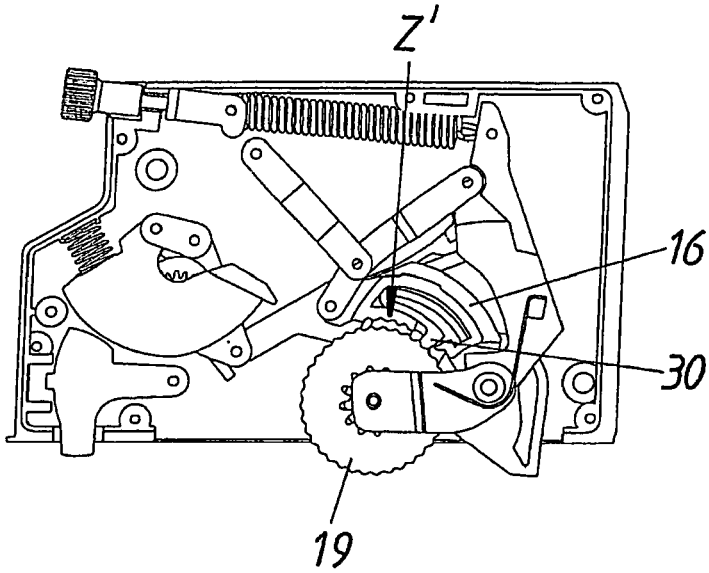

FIG. 21*b* relates to the position of the ejection device 4 shown in FIG. 21*a* and differs only in that the peripheral surface of the brake disk 19 and the corresponding section Z' of the coupling element 16 are toothed as in the first design example. Again, to avoid a jerky engagement of the brake disk 19 with the coupling element 16, a guide 30 is arranged on the coupling element 16.

Figure 22A:
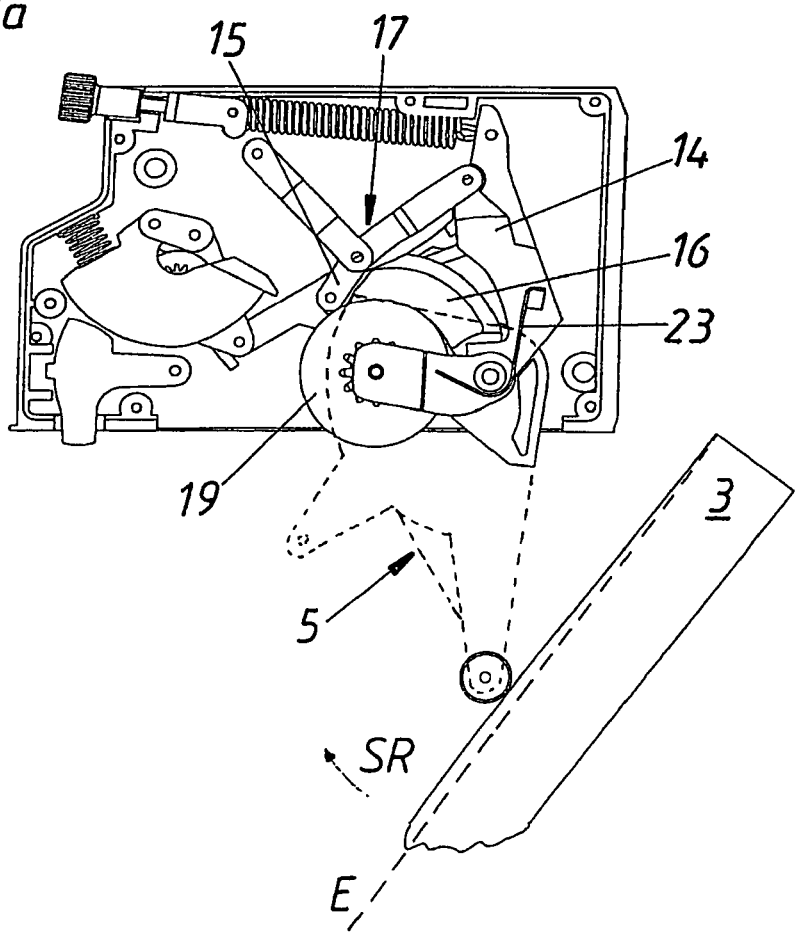
Figure 23:
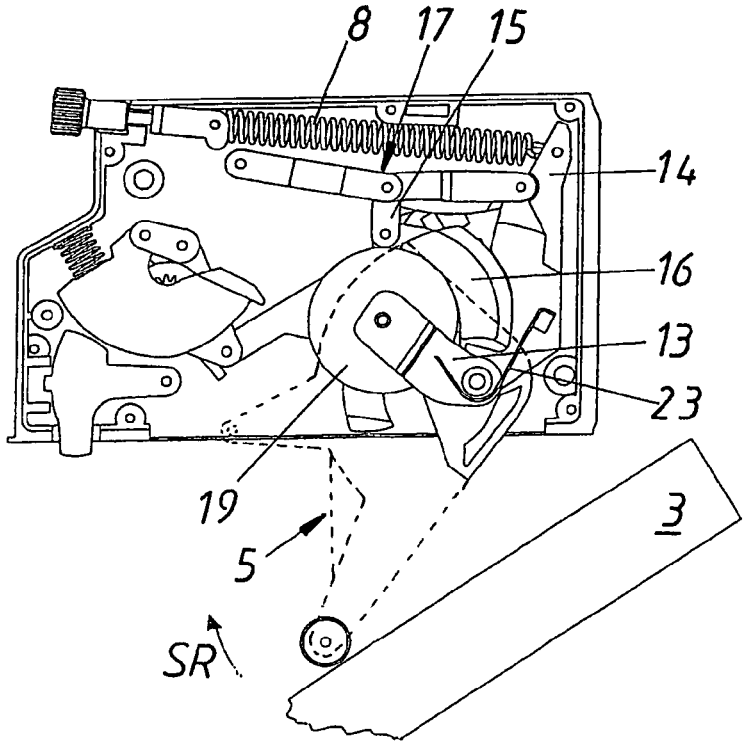

If the movable furniture part 3 is now moved from its opened end position in the closing direction SR, the brake disk 19 is brought into engagement with the toothed section Z' of the coupling element 16, as shown in FIGS. 22*a* and 23. This will block the rotation of the pinion 12 along the toothed section Z on the ejection element 5 and the coupling element 16 will be forced back in the closing direction SR into the housing 20 by the movement of the ejection element 5. The link element 14 is moved so far to the right by the coupling element 16 and the elbow lever 17 linked to it until the energy accumulator 8 of the actuator 6 is fully loaded. At the same time, this movement also loads the auxiliary actuator 23.

Figure 22B:
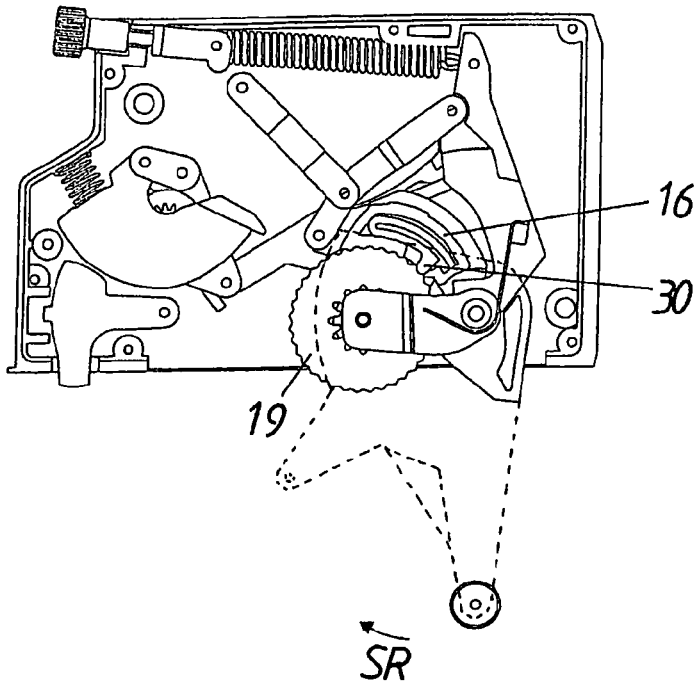

FIG. 22*b* again shows an alternative in which the peripheral surface of the brake disk 19 and the corresponding section Z' of the coupling element 16 are toothed. It can be seen that the action of the guide 30 ensures that the brake disk 19 and the toothed section Z' of the coupling element 16 engage with each other such that each tooth tip of the brake disk 19 engages with each tooth root on the toothed section Z' of the coupling element 16 which is able to prevent any jerky movements of the ejection element 5 and, thus, of the movable furniture part 3.

Figure 24:
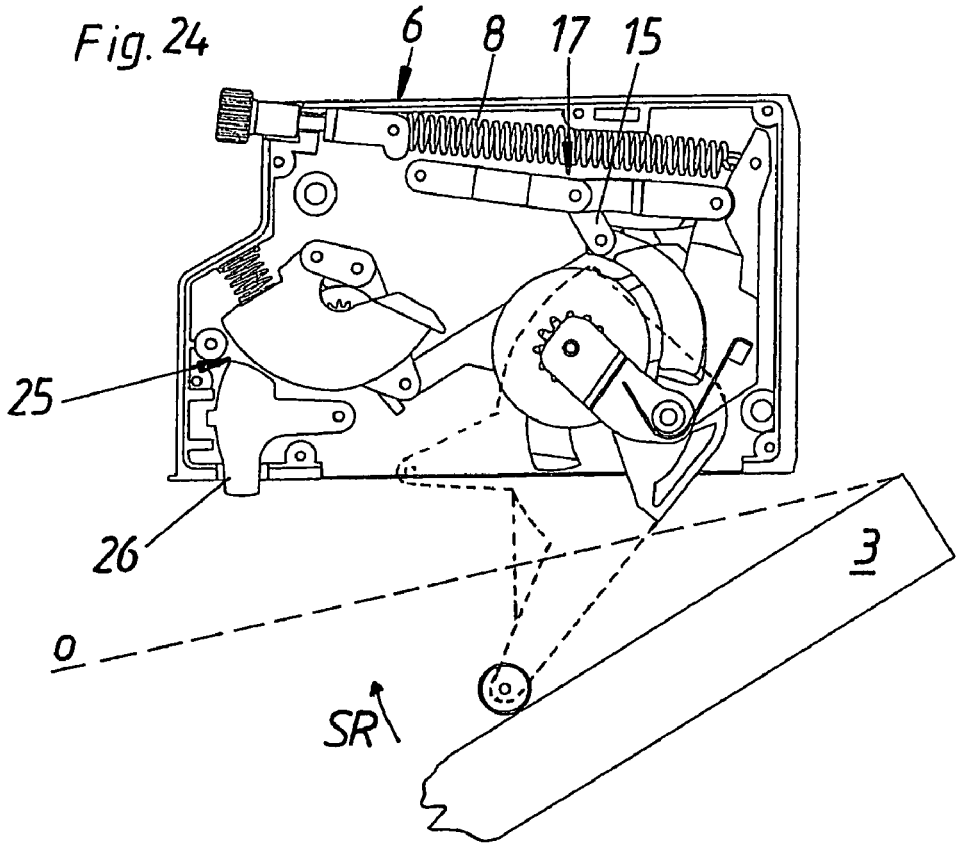

FIG. 24 differs from FIG. 23 in that the lever 15 of the dead point mechanism has now passed beyond the dead point of the elbow lever 17 so that the energy accumulator 8 of the actuator 6 is latched. Thus, the loading process for the energy accumulator 8 is concluded before the movable furniture part 3 has reached is first open position O. After the energy accumulator 8 has been loaded, the release element 26 of the release mechanism 25 remains in contact, with no play, with the movable furniture part 3 during the remaining section of its closing path.

Figure 25:
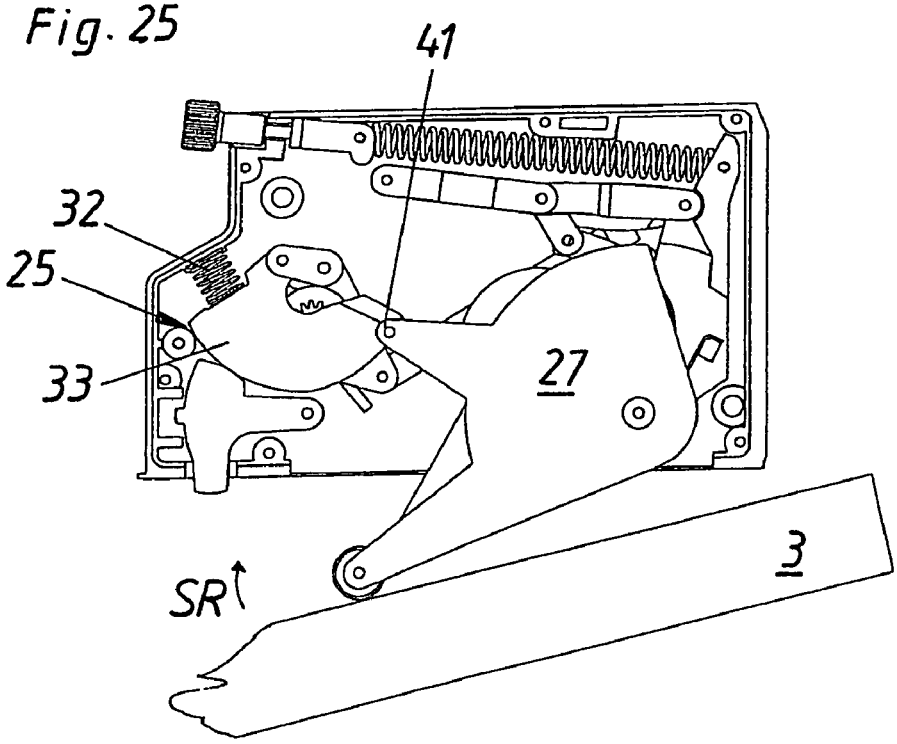

Moreover, as can be seen in FIG. 25, the upper part 27 of the ejection element 5 has a catch 41 which is formed to engage with an eccentric rotating element 33 of the release mechanism 25. This rotating element 33, as already mentioned, is acted on by a restoring spring 32 to ensure that the catch 41 engages with the rotating element 33 as the ejection element 5 retracts into the housing 20.

In FIG. 25, the catch 41 is now engaged with the eccentric rotating element 33, and carries it along with it in the closing direction SR of the ejection element 5. As the ejection element 5 retracts, the locking elements of the ejection device 4 remain unchanged for the energy accumulator 8, thus keeping the actuator latched.

Figure 26:
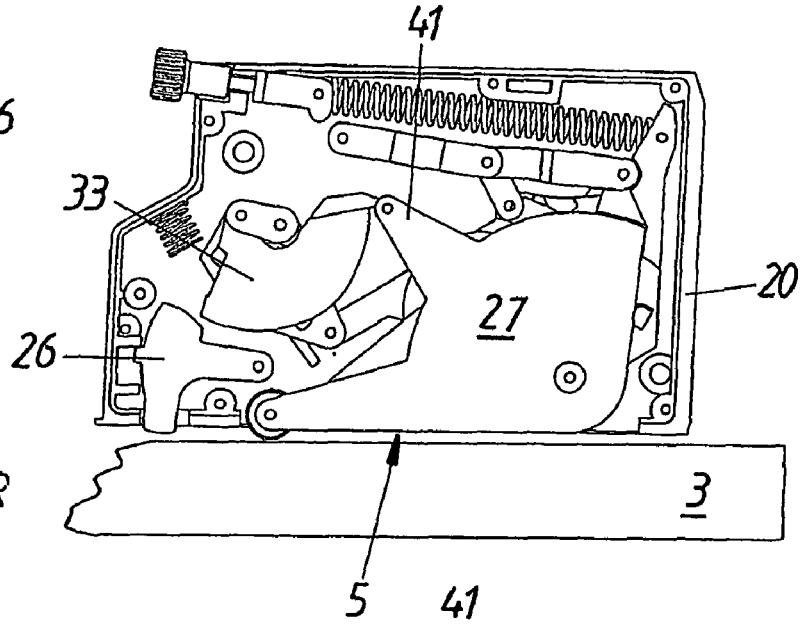

In FIG. 26, the catch 41 on the ejection element 5 has restored the eccentric rotating element 33 to its one end position. The eccentric rotating element 33 is connected via a toothed section (not shown) to the pinion 44 and the rotary damper 43 of the damper 36 to dampen the return movement of the rotating element 33.

Figure 27:
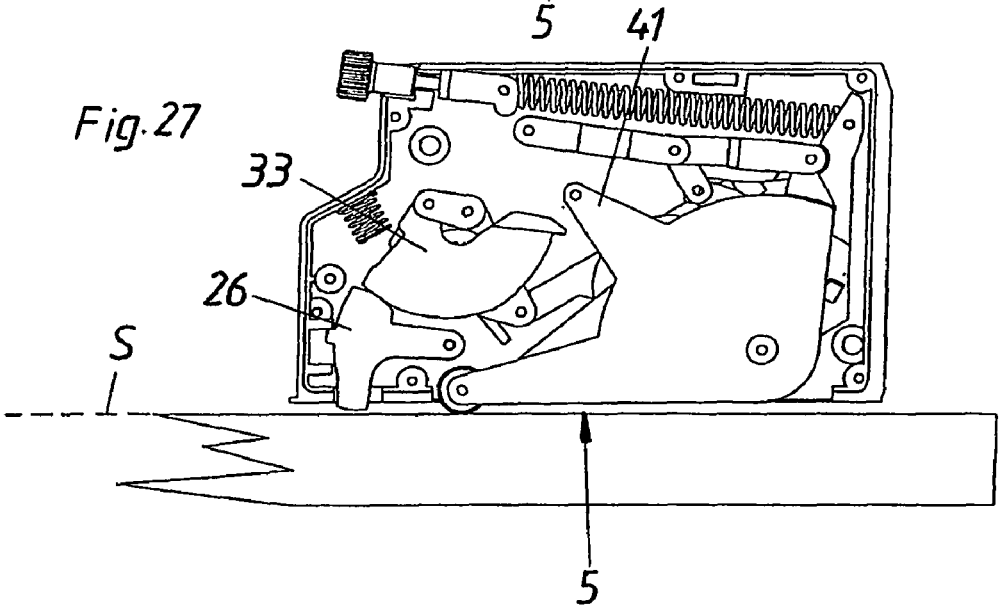

In FIG. 27, the movable furniture part 3 is now back in its closed position S, in which it can be retained by the hinge 28. The catch 41 on the ejection element 5 now snaps past the eccentric rotating element 33 which is moved to the left by the damper element 36. Due to the rolling contact joint formed between the eccentric rotating element 33 and the release element 26, the release element 26 is moved out of the housing 20 towards the movable furniture part 3 and just far enough so that the release element 26 rests on the movable furniture part 3 with no play between them (FIG. 28).

Figure 28:
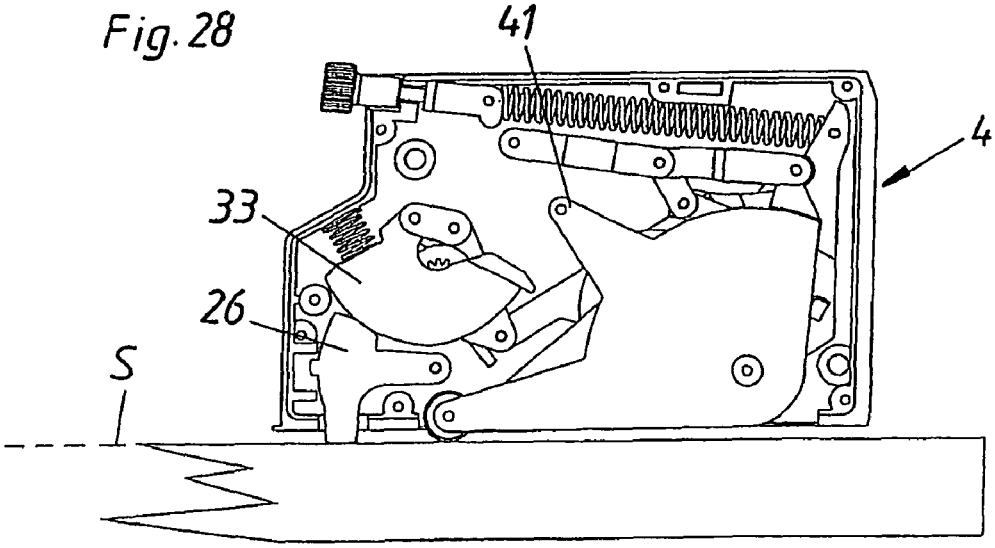

The configuration shown in FIG. 28 corresponds to that shown in FIG. 17, that is, the ejection element 5 is in the home position, with the actuator 6 latched, the movable furniture part 3 is in the closed position S and the release element 26 rests on the movable furniture part 3 with no play between them.

The design examples shown should not, of course, be regarded as limiting but rather simply as individual samples of innumerable possibilities for inventive concepts for producing a movable furniture part with an ejection element by means of which the movable furniture part is moved further in the opening direction after the end of the ejection process.

The invention claimed is:

1. A furniture item comprising:

a movable furniture part operable to move between a closed position and a full open position; and an ejection device including:

an ejection element for moving said movable furniture part from the closed position to a first open position located between the closed position and the full open position;

an actuator having an energy accumulator for actuating said ejection element, and for moving said ejection element as far as the first open position; and an auxiliary actuator comprising a manually-loaded energy accumulator for moving said ejection element beyond the first open position, said manually-loaded energy accumulator of said auxiliary actuator being separate from said energy accumulator of said actuator;

wherein said ejection device is arranged and operable to at least partly load said energy accumulator of said actuator via said ejection element during a closing movement of said movable furniture part in an area between the full open position and the first open position, said ejection element being pivotally mounted such that there is a difference between a first angle of said ejection element at the first open position of the movable furniture part, and a second angle of said ejection element between the full open position and the first open position of the movable furniture part at a start of a loading process of said energy accumulator; and wherein said manually-loaded energy accumulator of said auxiliary actuator is a manually-loaded energy accumulating spring.

2. The furniture item of claim 1, wherein said ejection device is operable to start the loading process of said energy accumulator of said actuator at the beginning of each closing movement of said movable furniture part regardless of a position of said movable furniture part.

3. The furniture item of claim 1, wherein said ejection device is shaped and arranged such that there is a difference between a first distance between a first contact point of said ejection element in a home position and a second contact point of said ejection element at the first open position, and a second distance between a third contact point of said ejection element in the home position and a fourth contact point of said ejection element at the start of the loading process of said energy accumulator of said actuator.

4. The furniture item of claim 1, further comprising a furniture body for supporting said movable furniture part, said auxiliary actuator being shaped and arranged to directly or indirectly contact said ejection element so as to move said ejection element in the opening direction beyond the first open position, said auxiliary actuator being located on at least one of said furniture body and said ejection device.

5. The furniture item of claim 1, wherein said auxiliary actuator is shaped and arranged to directly or indirectly contact said ejection element so as to move said ejection element in the opening direction beyond the first open position, said auxiliary actuator being located on said movable furniture part.

6. The furniture item of claim 1, wherein said energy accumulator of said actuator comprises a manually loaded energy accumulator.

7. The furniture item of claim 1, wherein said ejection element is arranged to follow movement of said movable furniture part in an area between the first open position and the closed position.

8. The furniture item of claim 7, wherein said ejection element is in contact with said movable furniture part during at least 50% of an opening movement and a closing movement of said movable furniture part.

9. The furniture item of claim 1, wherein a maximum opening angle of said ejection element is equal to a maximum opening angle of said movable furniture part.

10. The furniture item of claim 1, wherein said ejection element comprises a pivotable ejection element, and said actuator comprises a latchable coil tension spring, said pivotable ejection element and said coil tension spring being arranged to interact with a gear train.

11. The furniture item of claim 1, wherein said ejection device further includes at least one of an elbow lever and a dead point mechanism for latching of said actuator.

12. The furniture item of claim 1, further comprising a housing with an outlet aperture, said ejection device being arranged in said housing, said housing having an outlet aperture for said ejection element.

13. The furniture item of claim 1, wherein said manually-loaded energy accumulating spring comprises a curved leaf spring having a first leg engaging with said ejection element and a second leg engaging with a link element.

14. The furniture item of claim 1, wherein said manually-loaded energy accumulating spring comprises a spiral spring having a first leg engaging with said ejection element and a rotatable second leg engaging with a housing accommodating said ejection device.

15. The furniture item of claim 1, wherein said ejection device further includes a release mechanism with a release element to unlatch said actuator.

16. The furniture item of claim 15, wherein said release mechanism is shaped and arranged such that said release element rests in direct contact on one of said movable furniture part or a furniture body in the closed position of said movable furniture part.

17. A method of opening and closing said movable furniture part of said furniture item of claim 1, comprising:

contacting said ejection device by said actuator, said actuator including a manually loaded and latchable energy accumulator, said manually loaded energy accumulator being loaded during closing movement of said movable furniture part by said ejection element;

starting said loading process of said energy accumulator when said movable furniture part had been opened beyond the first open position during a closing movement of said movable furniture part in the area between the first open position and the closed end position.

18. The method of claim 17, wherein said starting of said loading process for the energy accumulator is performed with each closing movement of said movable furniture part independent of a position of said movable furniture part.

19. A furniture item comprising:

a movable furniture part operable to move between a closed position and a full open position; and an ejection device including:

an ejection element for moving said movable furniture part from the closed position to a first open position located between the closed position and the full open position;

an actuator having an energy accumulator for actuating said ejection element, and for moving said ejection element as far as the first open position; and an auxiliary actuator comprising a manually-loaded energy accumulator for moving said ejection element beyond the first open position, said manually-loaded energy accumulator of said auxiliary actuator being separate from said energy accumulator of said actuator;

wherein said ejection device is arranged and operable to at least partly load said energy accumulator of said actuator via said ejection element during a closing movement of said movable furniture part in an area between the full open position and the first open position, said ejection element being pivotally mounted such that there is a difference between a first angle of said ejection element at the first open position of the movable furniture part, and a second angle of said ejection element between the full open position and the first open position of the movable furniture part at a start of a loading process of said energy accumulator;

wherein said ejection device further includes a driving pinion secured to a rotatable bearing element, said ejection element being linked to said actuator through a link element, said ejection element having a section with gear teeth formed to engage with said driving pinion.

20. The furniture item of claim 19, wherein said ejection element, said bearing element, and said link element are arranged coaxially.

21. The furniture item of claim 19, wherein said ejection device further includes an elbow lever and a dead point mechanism for latching of said actuator, an arm of said elbow lever having a free end pivotally connected with said link element, and said dead point mechanism has a lever having a first end pivotally connected with an elbow of said elbow lever and having a second end pivotally connected with a curved coupling element such that said curved coupling element is rotatably secured coaxially with said link element.

22. The furniture item of claim 21, wherein said driving pinion is connected, so that it will not turn, to a coaxial brake disk whereby the brake disk is shaped so that it is in contact at its perimeter with said curved coupling element.

23. The furniture item of claim 19, further comprising a housing for accommodating said ejection device, said housing having a stop for said bearing element, said stop being located such that said bearing element rests on said stop when said movable furniture part is in the first open position.

* * * * *